US006907836B2

(12) United States Patent
Hagner

(10) Patent No.: US 6,907,836 B2
(45) Date of Patent: Jun. 21, 2005

(54) REBUILT DOUBLE HULL TANKER AND METHOD OF REBUILDING AN EXISTING SINGLE HULL TANKER INTO A REBUILT DOUBLE HULL TANKER

(75) Inventor: Thomas R. Hagner, Riverview, FL (US)

(73) Assignee: Maritrans, Inc., Tampa, FL (US)

( * ) Notice: Subject to any disclaimer, the term of this patent is extended or adjusted under 35 U.S.C. 154(b) by 0 days.

(21) Appl. No.: 10/806,904

(22) Filed: Mar. 23, 2004

(65) Prior Publication Data

US 2004/0237865 A1 Dec. 2, 2004

Related U.S. Application Data

(63) Continuation-in-part of application No. 10/371,832, filed on Feb. 21, 2003, now Pat. No. 6,708,636.

(60) Provisional application No. 60/394,577, filed on Jul. 9, 2002.

(51) Int. Cl.[7] ..... B63B 25/12

(52) U.S. Cl. ..... 114/74 A; 114/65 R

(58) Field of Search ..... 114/65 R, 74 R, 114/74 A

(56) References Cited

U.S. PATENT DOCUMENTS

| | | | | |
|---|---|---|---|---|
| 5,189,975 A | | 3/1993 | Zednik et al. | 114/74 |
| 5,218,919 A | | 6/1993 | Krulikowski, III et al. | 114/74 |
| 5,477,797 A | * | 12/1995 | Stuart | 114/65 R |
| 5,899,162 A | | 5/1999 | Beaupreet et al. | 114/74 |
| 5,909,715 A | * | 6/1999 | Menon | 114/65 R |
| 6,009,821 A | | 1/2000 | Al-Rammah et al. | 114/65 |
| 6,170,420 B1 | | 1/2001 | Hagner et al. | 114/65 |
| 6,357,373 B1 | | 3/2002 | Hagner et al. | 114/65 |
| 6,708,636 B1 | * | 3/2004 | Hagner | 114/74 A |

FOREIGN PATENT DOCUMENTS

| | | | |
|---|---|---|---|
| JP | 353040995 A | * | 4/1978 |
| JP | 358071288 A | * | 4/1983 |
| JP | 358174078 A | * | 10/1983 |
| JP | 61-24685 | | 2/1986 |
| JP | 61-24686 | | 2/1986 |
| JP | 403159895 A | * | 7/1991 |

* cited by examiner

*Primary Examiner*—Sherman Basinger
(74) *Attorney, Agent, or Firm*—Woodcock Washburn LLP

(57) ABSTRACT

The present invention relates to a rebuilt double hull tanker and a method of rebuilding an existing single hull tanker into a rebuilt double hull tanker. The rebuilt double hull tanker includes an internally rebuilt double bottom hull comprising the existing outer bottom hull and a new inner bottom hull that is disposed internal and spaced apart from the existing outer bottom hull and externally rebuilt double side hulls (e.g., port and starboard) comprising the existing inner side hulls and new outer side hulls disposed external and spaced apart from the existing inner side hull. The method includes forming the new double hull, including a new double bottom hull and new double side hulls, over at least the cargo carrying portion of the tanker by installing at least a portion of the new inner bottom hull internally over the existing outer bottom hull through cut-outs in the topside decking. The method also includes the use of model basin testing and computational fluid dynamics to assist in the hull design in the area of the transition regions between the new outer side hull and the existing side hull.

28 Claims, 34 Drawing Sheets

EXISTING MIDSHIP

MODIFIED MIDSHIP

MODIFIED BULKHEAD

OUTBOARD PROFILE

PLAN VIEW

FORWARD WEB FRAME

FORWARD BHD

LOOKING FORWARD
STIFFENERS ON AFT SIDE

SMOOTH TRANSITION FROM
DOUBLE HULL TO ORIGINAL SHAPE
(75c)
ADDED PRODUCTION-KINDLY SURFACES
(92)

Z
Y
X

Equivalent Speed: 14.5 knots

REBUILT DOUBLE HULL TANKER AND METHOD OF REBUILDING AN EXISTING SINGLE HULL TANKER INTO A REBUILT DOUBLE HULL TANKER

CLAIM OF PRIORITY

This application is a continuation-in-part of U.S. patent application Ser. No. 10/371,832, filed Feb. 21, 2003, now patent 6,708,636, and claims benefit under 35 U.S.C. §119 (e) to Provisional Application No. 60/394,577 filed on Jul. 9, 2002.

FIELD OF THE INVENTION

The invention relates generally to the field of seagoing tank vessels, and in particular, to a rebuilt double hull tanker and a method of rebuilding an existing single hull tanker into a rebuilt double hull tanker.

BACKGROUND OF THE INVENTION

The shipping and cargo moving industry is continually faced with customer demands for new and improved tank vessel designs and for new and improved methods of modifying the design of existing tank vessels. Substantial cost savings can be realized by a vessel owner in modifying or rebuilding existing tank vessels to incorporate improvements in tank vessel designs or otherwise extend the life of the tank vessel rather than paying the cost of building a new tank vessel.

In addition, new governmental and environmental regulations place certain restrictions and requirements on tank vessel owners and operators. These new or required designs must be capable of securely holding a cargo and also of being seaworthy. At the same time, a tank vessel must comply with shipping and environmental requirements and regulations.

Conventional tankers comprise a tank vessel having a single hull design. This type of hull construction provides a single outer hull or skin that provides structural integrity and acts as a boundary between the operating environment of the tanker (e.g., the sea) and the cargo and internal structure of the tanker. The single hull typically includes a shell having a bottom, a port side, a starboard side, a bow, a stern, and a plurality of bulkheads and internal stiffening frames that support and strengthen the shell of the hull.

Tankers are vessels specially designed to carry liquid or fluid-type cargoes, such as petroleum or chemical products. A problem unique to single hull tankers is that damage to the tanker's hull may lead to rupture of the tanker's cargo tanks and thus spill or leakage of the cargo. This results not only in the loss of cargo, but also in pollution of the marine environment and accompanying coastline.

As a result of the recent heightened environmental awareness and several shipping mishaps, new governmental regulations have been implemented requiring the use of double hulls on designated tank vessels in U.S. waters out to the 200 mile economic zone limit. These double hull requirements are contained in the Oil Pollution Act of 1990 (OPA-90) and have been incorporated in U.S. Coast Guard regulations. In part, OPA-90 requires that all new tank vessels constructed under contracts awarded after 1990 must have double hulls and that all existing single hull tank vessels engaged in the marine transport of oil and petroleum products be rebuilt with double hulls or be retired between the years 1995 and 2015, depending on the size and age of the tanker. The U.S. rules closely parallel those of the International Maritime Organization, which rules apply worldwide.

This has created a great burden on carriers having existing single hull tankers. These single hull tankers will either have to be rebuilt to incorporate a double hull design at great cost to the carrier, or the tankers will have to be retired, in many cases years before the end of their economically useful life.

Double hull designs have been used in the construction of newer tankers in an effort to comply with the requirements of the OPA-90. These double hull vessels typically have an outer hull and an inner hull. The outer hull and the inner hull each have shell plating that forms the structural integrity of the hull. A combination of transverse and longitudinal framing is provided between the inner and the outer hull to help strengthen the shell plating.

The idea behind a double hull is that the structural integrity of the outer hull may be breached without breaching the inner hull. Therefore, the outer hull may be breached, i.e., opened to the sea, while the cargo would remain securely contained within the inner hull. Thereby, a potential cargo spill will have been avoided. Typical cargos that have spilled in the past to cause environmental mishaps include cargos such as oil, petroleum, chemical, or other hazardous materials. Of course the provision of a double hull adds to the complexity and cost of new construction.

U.S. Pat. No. 5,218,919, entitled "METHOD AND DEVICE FOR THE INSTALLATION OF DOUBLE HULL PROTECTION," issued on Jun. 15, 1993 to Krulikowski et al. describes the construction of an auxiliary hull, exterior to the primary hull of a ship, which has the capacity to absorb impact energy preventing primary hull puncture, which may be retrofitted to existing single hull ships. However, this external fitting of a new auxiliary hull outside the entirety of the existing single hull to form a double hull is costly and significantly changes the operational characteristics of the vessel. Installing a new auxiliary hull over the existing bottom hull also affects the draft and lowers the baseline of the tanker, significantly affecting flow into the propeller. Also, this design does not meet OPA-90 requirements for minimum hull spacing.

U.S. Pat. No. 5,189,975, entitled "Method for Reconfiguration Tankers," issued Mar. 2, 1993 to Zednik et al. describes a method for converting a single hull tanker to a mid-deck configuration. As disclosed by Zednik et al., the mid-ship cargo section of the tanker is cut longitudinally along a horizontal plane well below the normal laden waterline. A spacer member including a new transverse mid-deck is interposed between the lower and upper portions of the mid-ship cargo section. A tank vessel having a mid-deck configurations are comprised of vertical cargo tanks (one above the other) and double sides, but do not include double bottoms and therefore are not as effective as double hulls, and do not meet OPA-90 requirements (e.g., this type of construction in the U.S. does not constitute a double hull and is considered to be a single hull).

Japanese patent JP 361024685 A, entitled "Method of Reconstructing Existing Tanker into Double Hull Tanker," and Japanese patent 61-24686 both show a method of reconstructing an existing tanker into a double hull tanker wherein a new inner hull and new inner side hulls are installed inside the existing outer plating. However, this method decreases the cargo carrying capability while at the same time also increases the draft of the vessel due to the increased weight of the double hull, both of which are undesirable.

U.S. Pat. Nos. 6,170,420 B1 and 6,357,373 B1 disclose internal rebuilt double hull vessels and methods of accomplishing same. These patents disclose a process wherein the topside decking is cut and removed and a new inner hull is disposed internally over the existing single hull to form the new double hull. While this internal double hull process works well for barges, it is not as effective for tankers for several reasons including (1) the use of a raised trunk to help maintain the same cargo carrying capacity on a rebuilt barge causes more visibility and operational issues on tanker than on a barge; (2) tankers are generally three tanks across instead of two, which causes structural complications with the new double sides not normally experienced with barges; (3) tankers typically have more services (fuel, oil, electricity, water, cargo handling, ship handling, etc.) that would be disrupted during a rebuild by cutting up the deck to create a raised deck than would a typical barge; (4) the increase in draft due to the additional weight of the new double hull would be greater for a typical tanker than a typical barge due to hull shape of a tanker, which would adversely affects marketing and may limit the cargo in several ports; (5) the extra steel weight on a tanker would represent lost cargo weight unlike the barge where the extra draft is allowed by regulation and compensates for the extra steel weight; (6) hull bending moment issues arising from the concentrated weights in the tanker's engine room which typically do not exist on a barge; and (7) the method used on a typical barge retrofit is difficult to accomplish on a typical tanker due to access and interference problems and modification of existing ship structure and piping.

Another problem associated with performing double hull rebuilds of existing single hull tankers is the time that the tanker must be in a graving dock or dry dock. The longer the tanker must be out of the water to complete the double hull rebuild the greater the expense of the rebuild. Therefore, it is desirable to reduce the amount of time that the tanker must be in the graving dock or dry dock.

In addition, another problem or potential limitation associated with performing double hull rebuilds of existing single hull tankers is graving dock or dry dock availability. For example, the size of the tanker to be rebuilt may limit the shipyards that can satisfactorily perform the double hull rebuild and/or the method that can be used to perform the rebuild.

Still another problem associated with the double hull rebuild is caused by externally fitting a new side hull externally over the existing side hull. The new outer side hull installed externally over the existing side hull increases the beam of the tanker and can result in a speed loss for the tanker due to an increased resistance of the tanker as it passes through the water. The new outer side hull can also adversely effect the flow of water into the propeller.

Therefore, a need exists for a rebuilt tanker having a double hull having substantially the same cargo carrying capability at substantially the same or a reduced draft. The need also exists for an improved method of rebuilding an existing single hull tanker into a rebuilt double hull tanker that minimizes disruptions in existing ship services and accounts for access and interferences problems and modifications of existing ship structure and piping. Furthermore, the need exists for a method of performing the double hull rebuild that reduces the time that the tanker is in a graving or dry dock and also takes into account limitations in the size and availability of graving and dry docks. Moreover, the need exist for ensuring a smooth flow of fluid over the hull to help minimize any speed loss for the rebuild double hull tanker.

SUMMARY OF THE INVENTION

The present invention is directed to a double hull tanker rebuilt and a method of rebuilding an existing single hull tanker into a rebuilt double hull tanker. The rebuilt double hull tanker includes a new double bottom hull and a new double side hull formed over at least the cargo carrying portion of the rebuilt tanker. The new double bottom hull includes an inner bottom hull formed from new inner bottom plating disposed internally and in a spaced apart relationship with an outer bottom hull formed from the existing bottom plating. The new port and starboard double side hulls include a new outer side hull formed from new outer side plating disposed externally and in a spaced apart relationship with an inner side hull formed from existing side plating. The rebuilt double bottom hull is connected at each end (e.g., at the turn of the bilge) to the rebuilt double side hulls.

In accordance with another embodiment within the scope of the present invention, the method of rebuilding an existing single hull tanker into a rebuilt double hull tanker includes an outer bottom hull formed from existing outer bottom plating. Temporary cut-outs are made in the existing topside decking and at least a portion of a new inner bottom hull is installed through the temporary cut-outs in the existing topside decking. A portion of the new inner bottom hull is formed from new inner bottom plating that is installed internally over the existing outer bottom plating. The new inner bottom hull and the existing outer bottom hull are then connected in a spaced apart relationship using a plurality of connecting members to form the new double bottom hull. Inner side hulls are formed from existing inner side plating. New outer side hulls are formed from new outer side plating installed externally over the existing inner side plating. The existing inner side hulls and the new outer side hulls are connected in a spaced apart relationship using a plurality of connecting members to form new port and starboard double side hulls. Preferably, the new double bottom hull and the new double side hulls form a new double hull over at least a cargo carrying portion of the rebuilt double hull tanker.

According to another aspect of the invention, the existing single hull tanker further includes at least one center cargo tank, a port wing cargo tank, and a starboard wing cargo tank. The method further includes the steps of cutting at least one temporary cut-out in the existing topside decking at a location between adjacent transverse bulkheads for each of the at least one center cargo tanks, and installing at least a center portion of the new inner bottom hull through the at least one temporary cut-out internally over existing web framing of each of the at least one center cargo tanks between the adjacent transverse bulkheads.

According to another aspect of the invention, the method further includes at least one temporary cut-out made in the existing topside decking at a location above each of the at least one center cargo tanks between adjacent longitudinal bulkheads. At least a center portion of the new inner bottom hull is then installed through the at least one temporary cut-out internally over the existing web framing of each of the at least one center cargo tanks between the adjacent longitudinal bulkheads.

According to another aspect of the invention, the method further includes at least one temporary cut-out made in the existing topside decking at a location above the port wing cargo tank between the existing side hull and an immediately inboard longitudinal bulkhead for each port wing cargo tank. At least a port side portion of the new inner bottom hull is installed through the at least one temporary cut-out and internally over existing web framing for each port cargo wing tank. At least one temporary cut-out is formed in said existing topside decking at a location above the starboard wing cargo tank between the existing side hull and an immediately inboard longitudinal bulkhead for each starboard wing cargo tank. At least a starboard side portion of the new inner bottom hull is installed through the at least one temporary cut-out and internally over existing web framing for each starboard cargo wing tank.

According to another aspect of the invention, the method further includes temporary access holes made into the existing port side plating at a location above a turn of the bilge and existing web framing of the existing single hull. At least a port side portion of the new inner bottom hull is installed through the temporary access holes in the existing port side plating and internally over the existing web framing for each port cargo wing tank. Temporary access holes are formed in the existing starboard side plating at a location above a turn of the bilge and existing web framing of the existing single hull. At least a starboard side portion of the new inner bottom hull is installed through the temporary access holes in the existing starboard side plating and internally over the existing web framing for each starboard cargo wing tank.

According to another aspect of the invention, the method further includes locating the temporary cut-outs in the existing topside decking at a location that minimizes the disruption of existing machinery and piping. In one embodiment, the temporary cut-outs include a length and a width, wherein the length of the temporary cut-out is oriented athwartships. The temporary cut-outs may include other orientations, such as orienting the length of the temporary cut-out fore and aft.

According to another aspect of the invention, the method further includes closing the temporary cut-outs in the existing topside decking using inserts. In one embodiment, the method further includes renewing existing topside decking that was removed to form the temporary cut-out to form inserts, and the inserts are used to close the temporary cut-outs in the existing topside decking after installation of the new inner bottom hull. Also, in embodiments having at least a portion of the new inner bottom installed through the side hull of the tanker, the method further includes renewing existing side plating that was removed to form the temporary access holes to form inserts, and the temporary access holes in the existing side plating are closed using the inserts after installation of the new inner bottom hull.

In one preferred embodiment, a portion of the existing single hull is cut-away at a turn of the bilge. This facilitates the installation of at least a portion of the new inner hull through the side shell of the tanker. In one embodiment, new bottom filler pieces are connected to each outboard end of the new double bottom hull where the existing turn of the bilge was cut-away. Preferably, the new bottom filler pieces are scribed to match the existing outer bottom hull, including any dead rise, and directly support the inner side hulls. The cut-away portion of the turn of the bilge is preferably reused after installation of the new inner hull. The cut-away portion of the turn of the bilge is connected to an outboard end of the new bottom filler pieces. New outer side filler pieces including the new outer side hull are preferably connected over the exterior of the existing port and starboard inner side hulls and connected to the existing turn of the bilges. The new outer side filler pieces include new outer portions of topside deck plating that are preferably scribed out to match a contour of the shear strake of existing topside deck plating and that are connected to an outer periphery of the existing topside deck plating.

According to another aspect of the invention, the method further includes forming one or more of slots in the new inner bottom plating at a location corresponding to a location of existing support brackets, such as, for example, between existing longitudinal bulkheads and existing transverse framing members. The new inner bottom plating is then laid on the existing transverse framing members while the one or more slots in the new inner bottom plating are fitted around the existing support brackets. Any space between the slots in the new inner bottom plating and the existing support brackets can be filled using a filler compound.

According to another aspect of the invention, the method further includes forming faired sections in a transition region between the new outer side hulls and the existing side hulls. The faired sections are preferably designed to provide a relatively smooth transition region between the new outer side hulls and the existing side hulls proximate a bow region and a stern region for a smooth hydrodynamic transition fore and aft in the area where the new double side hull and the existing single side hull meet. The method can further include one or more of the following steps: performing model basin testing of a model replica of the tanker to be rebuilt; and performing computational fluid dynamics of the tanker to be rebuilt.

According to another aspect of the invention, the step of performing model basin testing of a model replica of the tanker to be rebuilt further includes constructing a model representative of the existing single hull tanker; testing the model representative of the existing single hull tanker; constructing a model representative of the rebuilt double hull tanker; testing the model representative of the rebuilt double hull tanker. A molding material can be used to simulate one or more designs for the faired sections by applying successive layers of the molding material to an exterior of the model replica of the rebuilt double hull tanker to be rebuilt in a bow transition region and a stern transition region. The results of the testing of the model representative of the existing single hull tanker can be compared with the results of the testing of the model representative of the rebuilt double hull tanker having the successive layers of the molding material. The faired sections for the actual tanker to be rebuilt can then be designed and constructed based on the comparison of the model basin testing.

According to another aspect of the invention, the step of performing computational fluid dynamics of the tanker to be rebuilt further includes: providing a computing system having software for performing basic equations of fluid motion by massive iterative computations; inputting data representative of said existing single hull tanker; generating results for said existing single hull tanker; inputting data representative of one or more designs for said faired sections of said tanker to be rebuilt; generating results for said tanker to be rebuilt; comparing results of said computations of said existing single hull tanker with results of said computations of said rebuilt double hull tanker having one or more designs for the faired sections; and designing the faired sections based on said comparison of the computational fluid dynamics.

According to another aspect of the invention, the steps of performing model basin testing and performing computational fluid dynamics further include the steps of computing of and comparing one or more of: flow fields in the bow region; flow fields in the stern region; surface pressure contours at the bow region below the waterline; surface pressure contours at the stern region below the waterline; bow wave contours; and bare-hull resistance.

According to another aspect of the invention, the method further includes the steps of: comparing results of the step of performing model basin testing with results of the step of performing computation fluid dynamics; and designing the faired sections based on the comparison of the model basin testing and the computational fluid dynamics.

In accordance with another embodiment within the scope of the present invention, the method of rebuilding an existing single hull tanker into a rebuilt double hull tanker comprising the steps of: forming an outer bottom hull from existing outer bottom plating; forming the new inner bottom hull from new inner bottom plating installed internally over said existing outer bottom plating; connecting the new inner bottom hull and the existing outer bottom hull in a spaced apart relationship using a plurality of connecting members to form a new double bottom hull; forming inner side hulls from existing inner side plating; forming new outer side hulls from new outer side plating installed externally over the existing inner side plating; and connecting the existing inner side hulls and the new outer side hulls in a spaced apart relationship using a plurality of connecting members to form new port and starboard double side hulls; wherein the new double bottom hull and the new double side hulls form a new double hull over at least a cargo carrying portion of the rebuilt double hull tanker; forming faired sections in a transition region between the new outer side hulls and the existing side hulls; and designing the faired sections to provide a relatively smooth transition region between the new outer side hulls and the existing side hulls proximate a bow region and a stern region for a smoothing hydrodynamic transition fore and aft in the area where the new double side hull and the existing single side hull meet.

According to another aspect of the invention, the step of designing the faired sections further comprises one or more of the following steps: performing model basin testing of a model replica of the tanker to be rebuilt; and performing computational fluid dynamics of the tanker to be rebuilt.

Additional features of the present invention are set forth below.

DETAILED DESCRIPTION OF THE PREFERRED EMBODIMENTS

Figure 1:
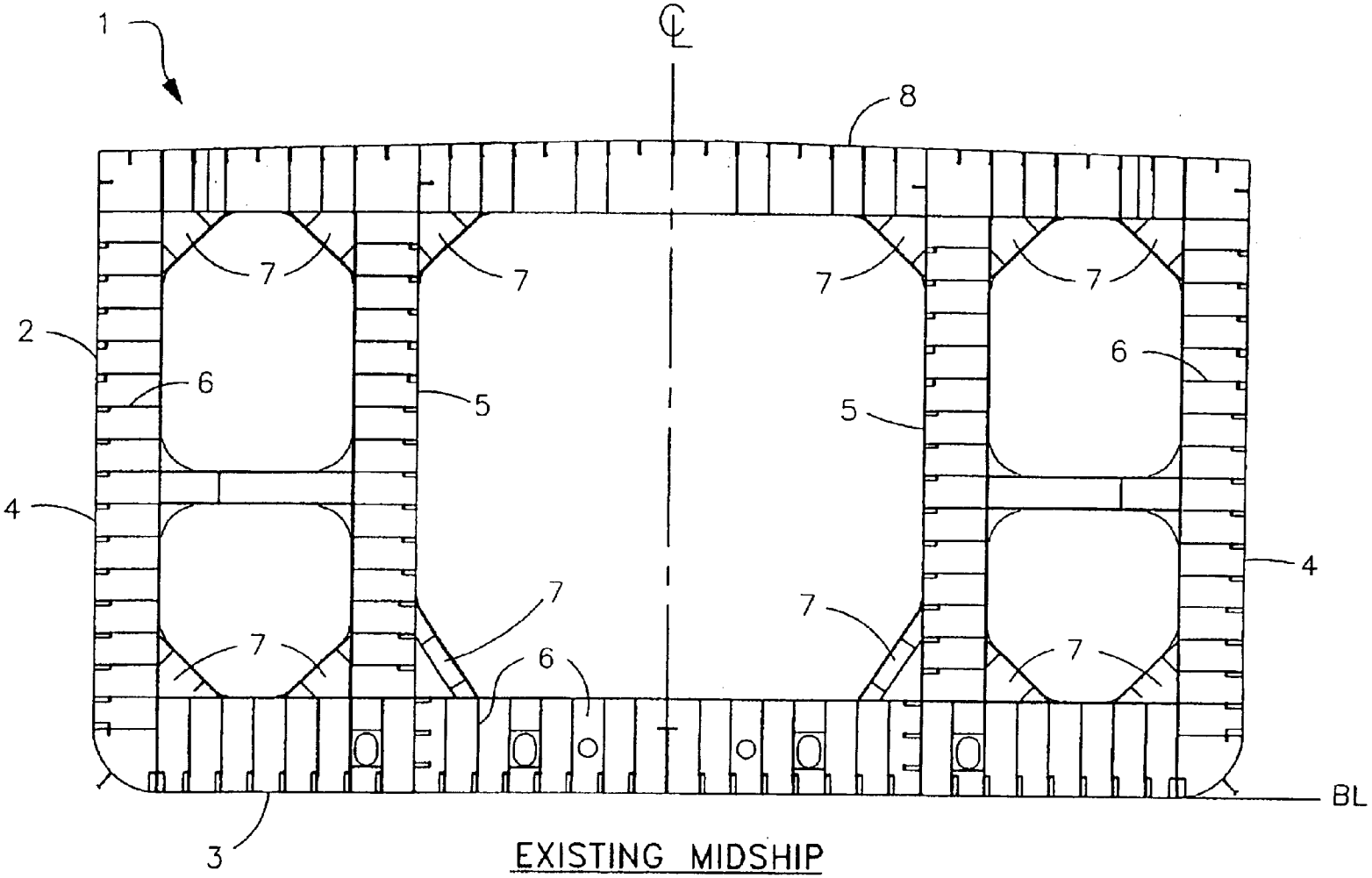
FIG. 1 (PRIOR ART)
FIG. 1 is a cross sectional mid-ship view showing an exemplary prior art tanker having a single hull.

FIG. 1 shows an exemplary existing single hull tanker design. As shown in FIG. 1, the existing single hull tanker 1 includes a single outer hull or skin 2 that provides structural integrity and acts as a boundary between the operating environment of the tanker (e.g., the sea) and the cargo and internal structure of the tanker. As shown, the single hull includes shell plating having bottom plating 3, and port and starboard side plating 4. A plurality of bulkheads 5 and internal stiffening frames 6, act to support and strengthen the shell of the hull. Conventional bulkheads typically include a combination of transverse and longitudinal bulkheads and the internal framing typically includes a combination of transverse and longitudinal members. As shown in FIG. 1, a typical tanker can include a plurality of brackets 7 for supporting and stiffening the cargo hold at, for example, the connection of the side walls and longitudinal bulkhead to the topside deck plating 8 and to the web frames of the bottom hull. The single hull tanker 1 shown in FIG. 1 includes a typical framing design, although the invention is not limited to this type of tanker design.

In the illustrated embodiments of the invention shown in FIGS. 2–7, a rebuilt double hull tanker 10 is shown including a rebuilt double hull 11 comprising a new double bottom hull 12 and new double side hulls 13 (e.g., port and starboard side hulls). The internally rebuilt double bottom hull 12 comprises the existing outer bottom hull 14 (e.g., the existing bottom plating 3) and a new inner bottom hull 15 that is disposed internal and spaced apart from the existing outer bottom hull 14. The externally rebuilt double side hulls 13 comprise the existing inner side hulls 16 (e.g., the existing port and starboard side plating 4) and a new outer side hull 17 disposed external and spaced apart from the existing inner side hull 16. The rebuilt double bottom hull 12 is connected at each end (e.g., at the turn of the bilge 18) to the rebuilt double side hulls 13, comprising port and starboard outer side hulls.

The new inner bottom hull 15 and the new outer side hulls 17 are connected in a spaced apart relationship to the existing outer bottom hull 14 and the existing inner side hulls 16, respectively. One or more watertight cavities 19 are defined between the existing outer bottom hull 14 and the new inner bottom hull 15 and also between the existing inner side hull 16 and the new outer side hull 17. These cavities 19 can be used as tanks for the storage of, for example, ballast.

Figure 2:
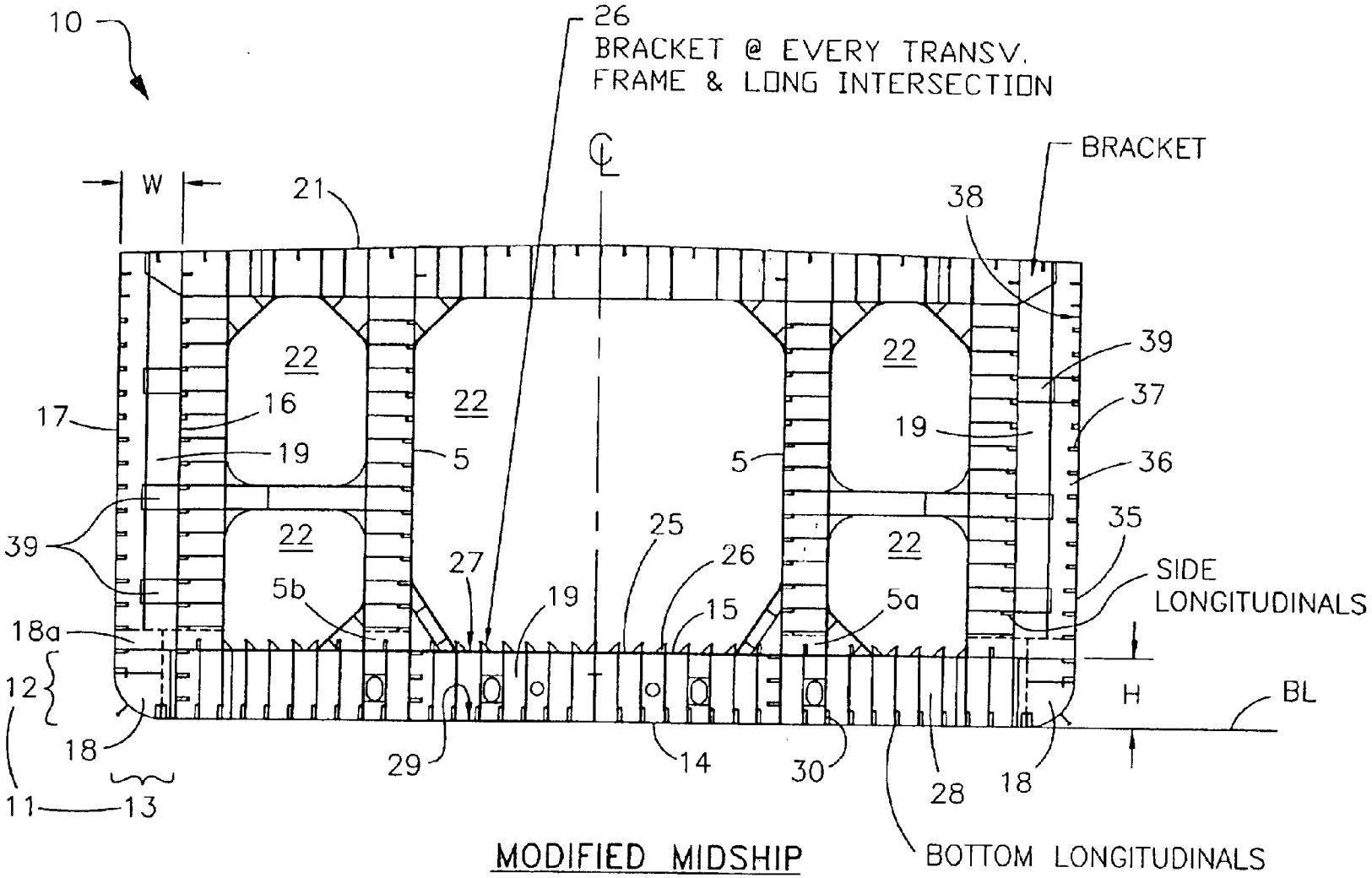
FIG. 2 is a cross sectional mid-ship view at a typical modified web frame showing an exemplary rebuilt double hull tanker in accordance with one embodiment of the present invention.

As shown in FIG. 2, the new inner bottom hull 15, the existing inner side hulls 16, and the topside decking 21, define a cargo hold 22 for carrying a cargo (not shown). The cargo is preferably a liquid cargo. The existing outer bottom hull 14, the new outer side hulls 17, and the topside decking 21 define a boundary with the outside operating environment (e.g., the sea and the air). The cargo hold 22 can be separated into on or more cargo holds by transverse bulkheads, longitudinal bulkheads, or a combination of both.

In one preferred embodiment shown in FIG. 2, the new inner bottom hull 15 includes inner bottom plating 25 and stiffeners 26. As shown in FIG. 2 the stiffeners 26 can include longitudinal stiffeners disposed on a topside surface 27 of the inner bottom plating 25. Locating the stiffeners 26 on the topside 27 of the inner bottom plating 25 is preferred because this arrangement allows for ease of installation because this leaves the bottom-side of the plating smooth, making fit-up easier and the installation process quicker. This preferred configuration also allows the new inner bottom hull 15 to be prefabricated as a plurality of pieces on a jig using, for example, down-hand welding, which also reduces the cost and improves quality of the construction. The stiffeners 26 are preferably connected to the inner bottom plating 25 at equal spacing to provide the necessary structural integrity and stiffening of the inner bottom plating 25.

The new inner bottom hull 15 is connected to the existing outer bottom hull 14 in a spaced apart relationship. As shown in FIG. 2, in a preferred embodiment the new inner bottom hull 15 can be disposed on and connected directly to the existing framing 28 extending inward from the existing outer bottom hull 14 providing the existing frame height H is sufficient to meet OPA-90 requirements for outer and inner hull separation. As shown, in one embodiment the existing framing that the new inner hull 15 is installed over can include the transverse web framing. In an alternative embodiment (not shown), the existing framing could include the existing longitudinal framing 30.

The frame height H is measured, for example, between the topside 29 of the existing outer bottom hull 14 and the topside 27 of the top flange of the transverse web frame 28. Installing and connecting the new inner bottom hull 15 directly to the existing framing 28 is preferred because the use of the existing structure minimizes the amount of work required and the time that the tanker is out of service. Alternatively, if the existing framing height does not meet OPA-90 requirements, a connecting or filler plate (not shown) can be used to connect the new inner bottom hull 15 to the existing outer bottom hull structure 14.

According to OPA-90, the spacing requirements for double bottom tanks or spaces is defined by the distance H between the bottom of the cargo tanks and the moulded line of the bottom shell plating measured at right angles to the bottom shell plating and is not less than H=beam/15 or 2 meters, whichever is the lesser. The minimum value of H=1 meter.

For the side tanks or spaces, the minimum spacing is based on deadweight and is required to extend either for the full depth of the tanker's side or from the top of the double bottom to the uppermost deck, disregarding a rounded gunwale where fitted. Nowhere should the spacing be less than the distance W which is measured at any cross-section at right angles to the side shell and defined by W=0.5+deadweight/20,000(m) or 2 meters, whichever is the lesser. The minimum value of W=1 meter.

As shown in FIG. 2, the new outer side hull 17 each include side plating 35, web framing 36, and stiffeners 37. As shown, the web framing 36 can include transverse web framing that is connected to an interior surface 38 of the new outer side plating 35 and extends inward toward the existing inner side hull 16. The stiffeners 37 can include longitudinal stiffeners disposed on the interior surface 38 of the new outer side plating 35 at equal spacing to provide the necessary structural integrity and stiffening of the new outer side plating 35. The new outer side hulls 17 are connected to the existing inner side hulls 16 in a spaced apart relationship.

As shown in FIG. 2, connecting plates 39 can be used to connect the new external side plating 35 of the new outer side hull 17 to the side plating of the existing inner side hull 16.

Preferably, the rebuild process includes removal and reuse of the existing turn of the bilge 18. This piece is cut-out and removed for installation of the new inner hull 15 from the side of the tanker. The turn of the bilge 18 may be reworked as necessary for re-installation after the new inner hull 15 has been installed. Preferably, the cut-out of the turn of the bilge includes at least a portion 18*a* of the existing side shell vertically above the existing web framing proximate the top of the turn of the bilge.

Due to the increase in the beam B of the tanker resulting from the new outer side hulls 13, filler pieces or new bottom filler pieces 62 are installed at each end of the double bottom hull 12 and then the turn of the bilge 18 is connected to the outer ends of the new bottom filler pieces 62. Preferably, the width of the new bottom filler pieces 62 is approximately equal to the width of the new outer side hulls 13.

Figure 3:
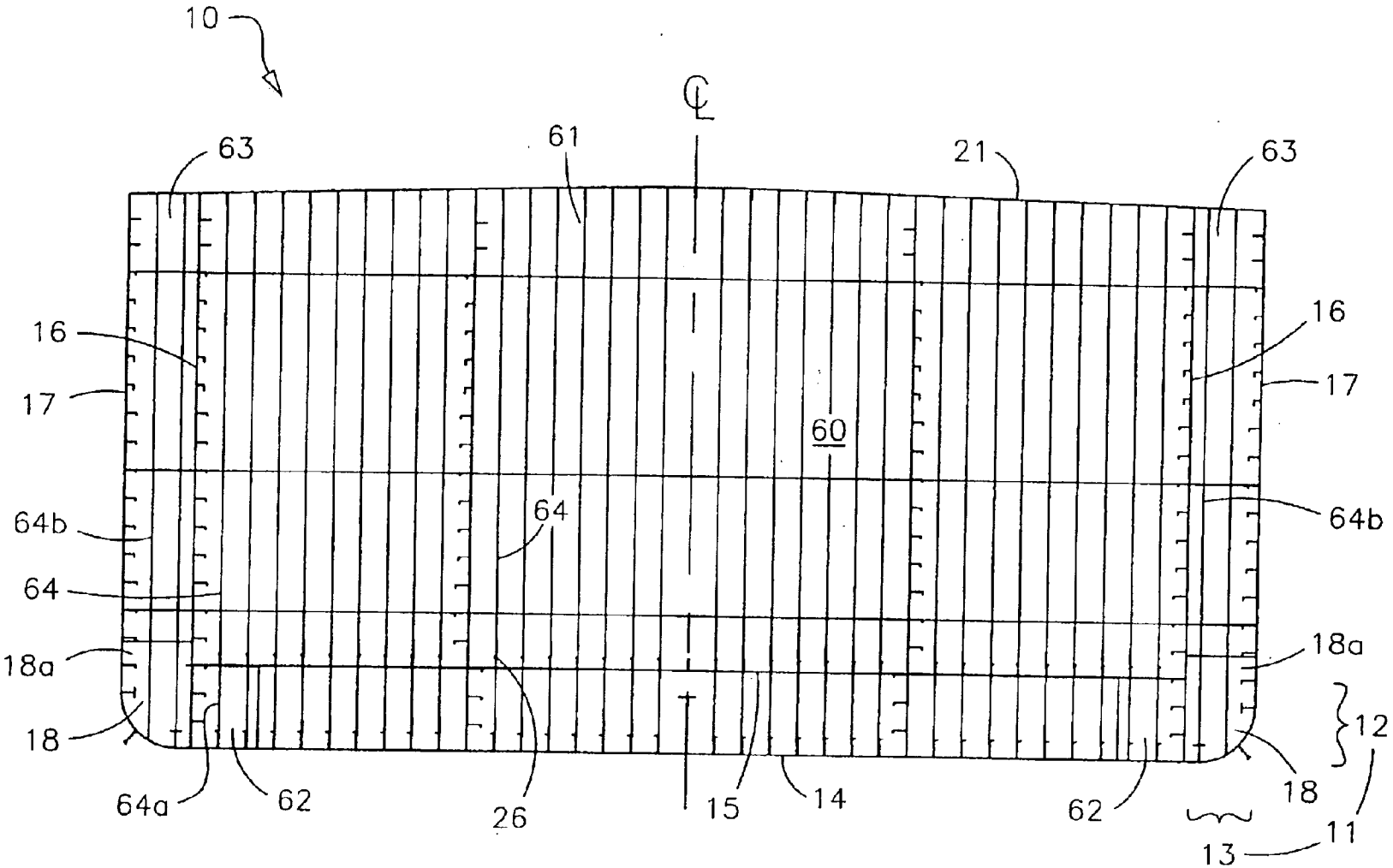
FIG. 3 is a cross sectional mid-ship view at a typical modified bulkhead of an exemplary rebuilt double hull tanker in accordance with one embodiment of the present invention.

FIG. 3 is a cross-sectional view of a rebuilt double hull tanker 10 showing an exemplary modified bulkhead 60 that includes the new inner bottom hull 15 fitted internally in relation to the existing outer bottom hull 14 and new outer side hulls 17 fitted externally in relation to the existing inner side hulls 16. As shown in FIG. 3, the rebuilt bulkhead 60 includes the existing bulkhead structure 61, new bottom filler pieces 62, and new side filler pieces 63. The bottom filler pieces 62 are used to fill the space between the existing bottom hull structure and the turn of the bilge resulting from the increase in the beam B resulting from the new external side filler pieces 63. In one embodiment, the bottom filler pieces 62 are sized to fill a space that has a width that is approximately equal to the width of the new double side hulls 13 and a height approximately equal to the height of the new double bottom hull 12. The two side filler pieces 63 extend from the top of the turn of the bilge on both the port and starboard sides up to the topside deck plating 21. The width of the side filler pieces 63 is determined by the width of the rebuilt double side hulls 13.

Stiffeners 64 are provided for stiffening the rebuilt bulkhead 60. As shown in FIG. 3, the new longitudinal stiffeners 26 are attached to the existing bulkhead stiffeners 64. New portions of bulkhead stiffeners 64*a* are provided in the area of the bottom filler pieces 62 that correspond to and are connected to the existing bulkhead stiffeners 64 and new bulkhead stiffeners 64*b* are provided on the new side filler pieces 63.

Figure 4:
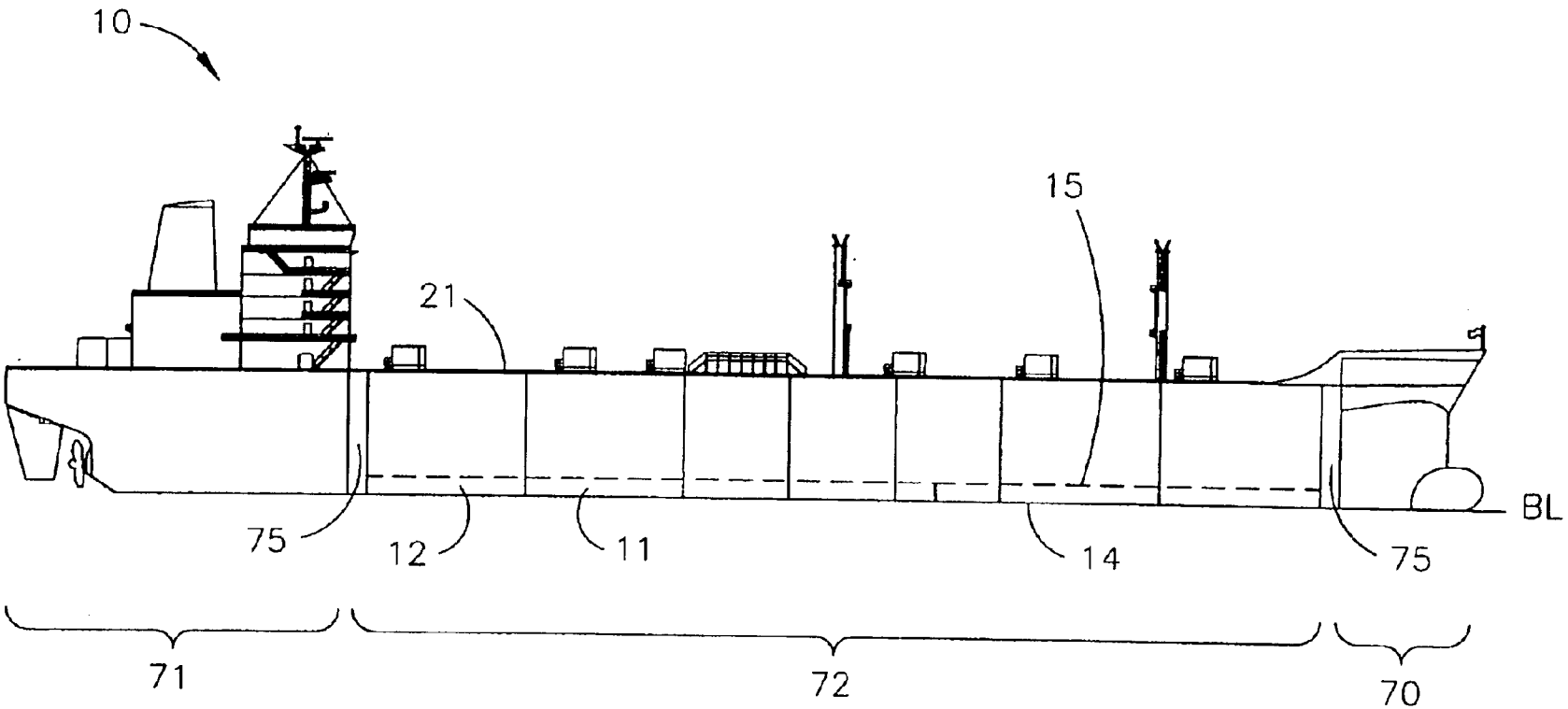
FIG. 4 shows an outboard profile of an exemplary rebuilt double hull tanker.
Figure 5:
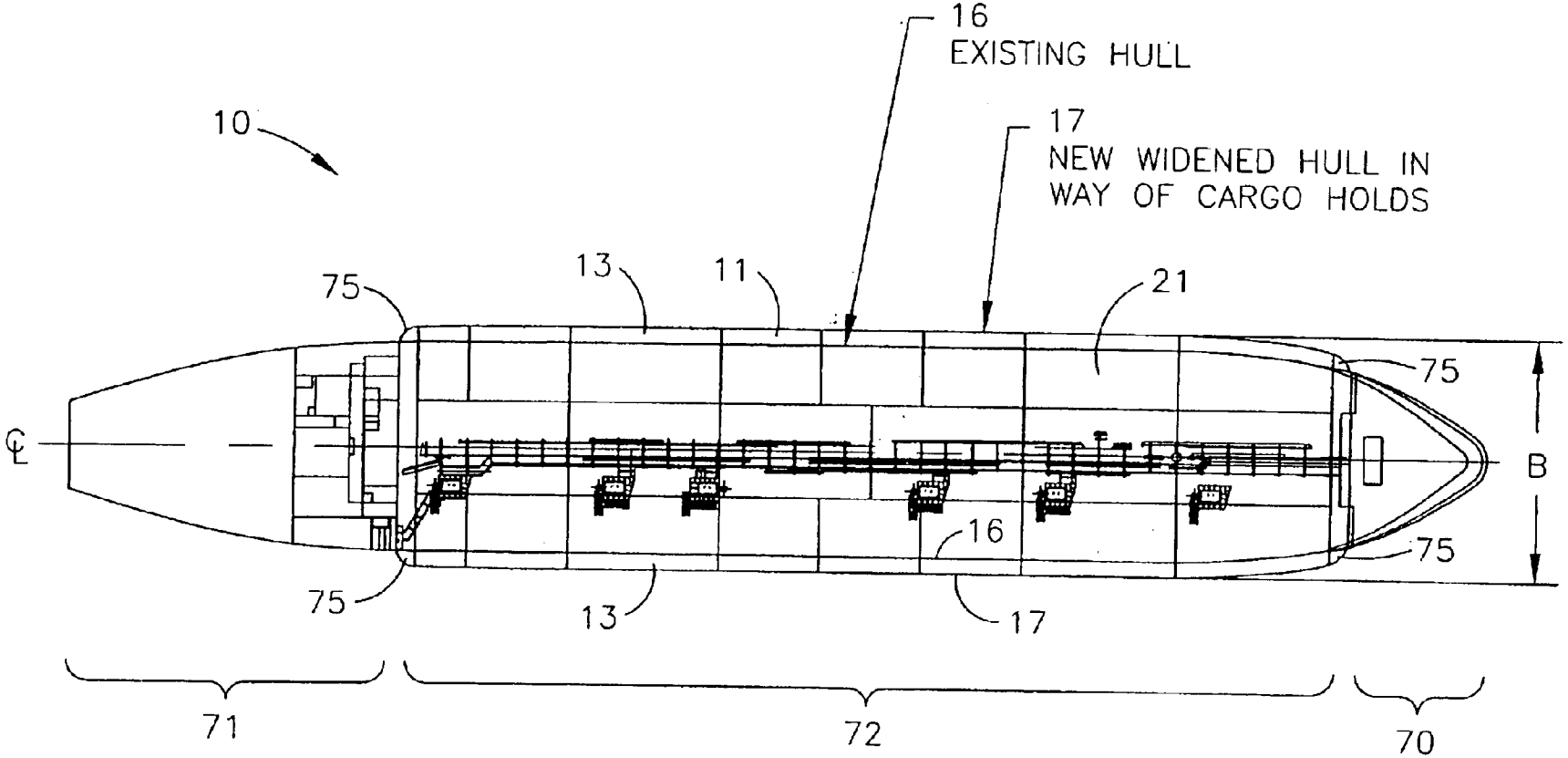
FIG. 5 shows a plan view of the exemplary tanker of FIG. 4.

FIG. 4 is an outboard profile of the rebuilt double hull tanker 10 and FIG. 5 shows a plan view of the rebuilt double hull tanker 10 illustrating the new double hull 11, including the new double bottom hull 12 and the port and starboard double side hulls 13. As shown in FIGS. 4 and 5, the rebuilt double hull 11 extends between the bow section 70 and the stern section 71 of the rebuilt tanker 10. Preferably, the rebuilt double hull 11 extends over at least the length of the cargo carrying portion 72 of the tanker 10.

The existing bottom hull 3 from the original single hull tanker 1 forms the outer bottom hull 14 of the rebuilt double hull tanker 10, which provides an advantage in that this bottom hull has been proven in service. The existing side hulls 4 from the original single hull tanker forms the inner side hulls 16 of the rebuilt double hull tanker 10, which provides an advantage in that these side hulls are suitable for contact with a cargo. As can be seen from FIGS. 4 and 5, the insertion of the new inner bottom hull 15 from the side of the tanker 10 and the new outer side hulls 17 installed externally allows the conversion of the tanker 10 with no or minimal disruption of the topside deck plating 21, machinery, piping, super structure, and the like.

As can be seen from FIG. 4, the base line BL of the tanker remains the same for the rebuilt double hull tanker 10 as it was for the original single hull vessel 1. As illustrated in FIG. 5, the beam B of the rebuilt double hull tanker 10 is greater than the beam of the original single hull tanker 1. The increase in the beam B of the rebuilt double hull tanker 10 is approximately equal to the width of the two new double side hulls 13 (e.g., the port and starboard side hulls). In the preferred embodiment shown in FIGS. 4 and 5, this widened beam B of the rebuilt double hull tanker 10 resulting from the new double side hulls 13 is formed at least over the length of the cargo carrying portion 72.

FIGS. 4 and 5 also show faired sections 75 that form a relatively smooth transition between the new outer side hulls 17 and the outer hull 4 of the existing single hull 2 proximate the bow section 70 and the stern section 71. The faired sections 75 provide for a smoothing hydrodynamic transition fore and aft. In one embodiment, the faired sections 75 are formed with an elastomer fairing compound.

Figure 6:
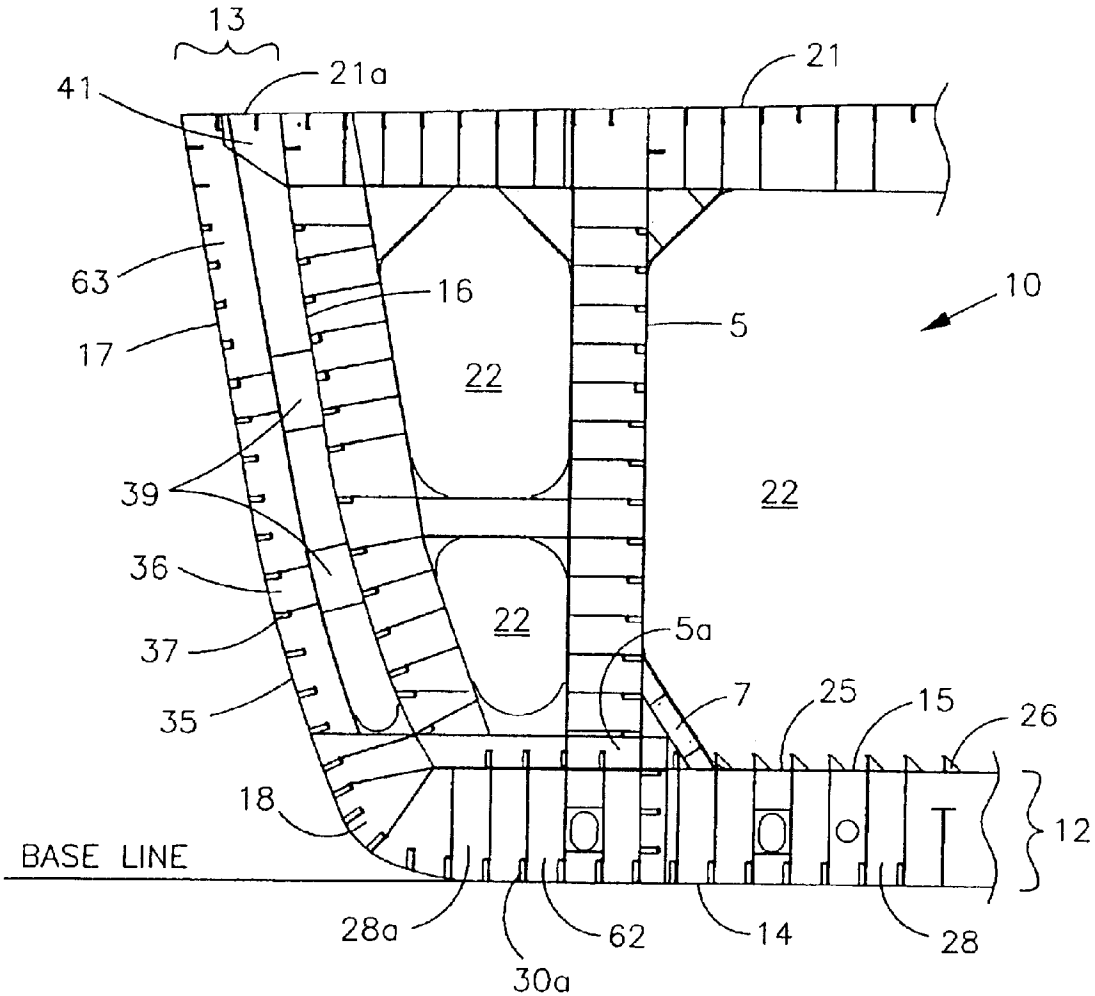
FIG. 6 shows a partial cross-sectional view at a forward web frame of the tanker of FIG. 4 looking forward.

FIG. 6 shows a partial cross-sectional view at a forward web frame 28 of the tanker 10 of FIGS. 4 and 5 looking forward. Basically, the same method described heretofore is applicable for the forward-most to the aft-most frames for the entire cargo length. As shown in FIG. 6, the rebuilt double hull 10 includes existing topside deck plating 21, existing outer bottom hull plating 14, existing inner side hull plating 16, existing longitudinal bulkhead 5, existing turn of the bilge 18, existing support brackets 7, new inner bottom plating 25, new inner bottom stiffeners 26, new outer side shell plating 35, new bottom filler piece 62, new side filler piece 63, and new bracket 41.

As shown, the new inner bottom plating 25 of the new inner hull 15 is disposed over and connected to the web frames 28 extending upward from the existing outer bottom hull 14. A bottom portion 5*a* of the longitudinal bulkhead(s) 5 can be cut out and removed to allow installation of the new inner bottom hull 15 and preferably this same piece is re-installed after the new inner bottom 15 has been installed.

A new bottom filler piece 62 is connected at each end (port and starboard) of the new double bottom 12. The existing turn of the bilges 18 (port and starboard) are connected to the outboard end of each of the new bottom filler pieces 62.

The new outer side shell plating 35 of the new outer side hull 17 is connected to the existing inner side hull plating 16 using connecting plates 39. Preferably, the new side filler pieces 63, including the new outer side plating 35, new side shell web framing 36, new side shell stiffeners 37, and the connecting plates 39, are prefabricated and installed as one piece.

The new outer portion 21*a* of the topside deck plating is then connected to the outer periphery edge of the existing topside deck plating 21. Preferably, the existing topside deck plating 21 is left substantially undisturbed. As shown in FIG. 6, a bracket 41 can be used to attach and stiffen the new topside deck plating 21*a* to the existing ship structure.

Stiffeners 26, 28, 36, 37 are provided on the new structure to support and stiffen the new shell plating 25, 35. For example, as shown in FIG. 6 the new inner bottom plating 25 includes new longitudinal stiffeners 26, the new bottom filler pieces 62 can include transverse stiffener 28*a* and longitudinal stiffeners 30*a*, and the new side filler pieces 63 can include transverse stiffeners 36 and longitudinal stiffeners 37.

Figure 7:
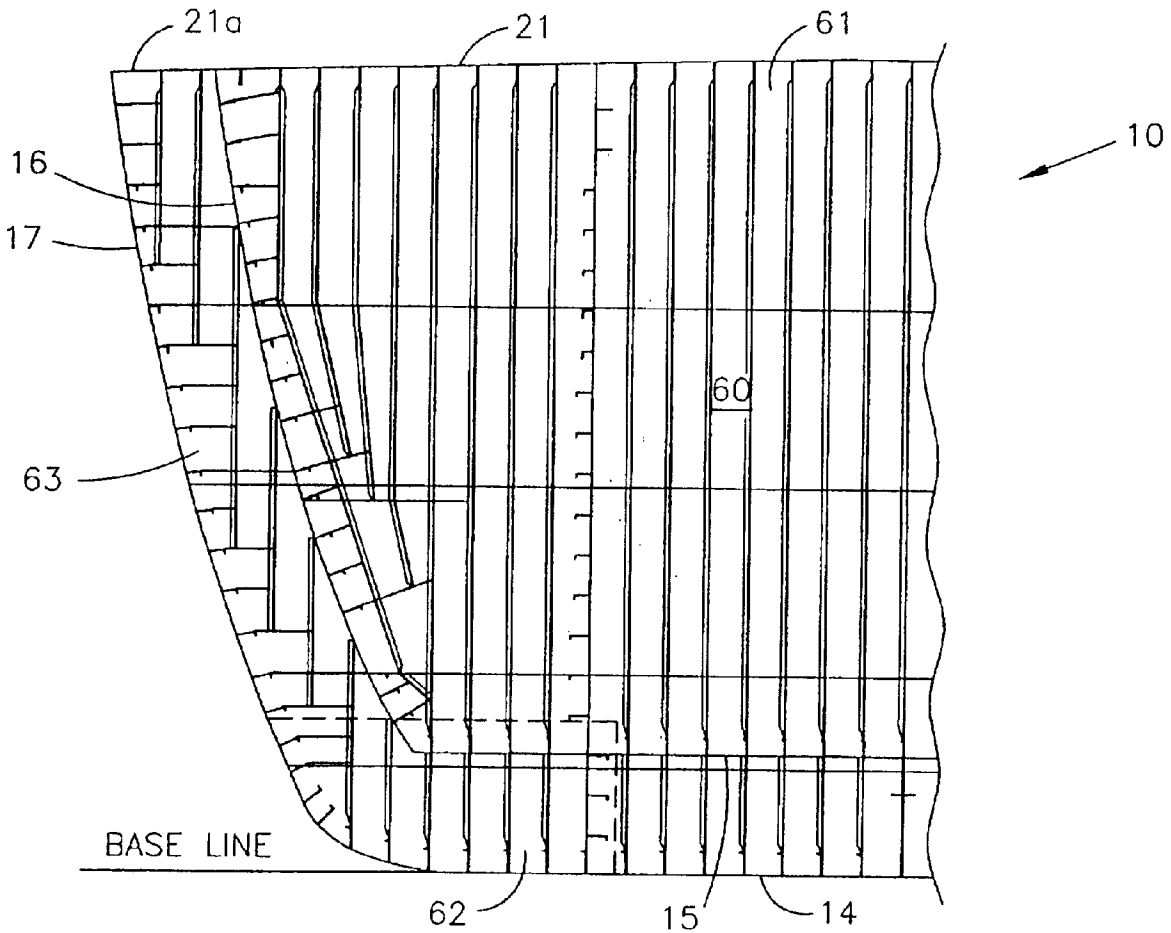
FIG. 7 shows a partial cross-sectional view at a forward bulkhead of the tanker of FIG. 4 looking forward.

FIG. 7 shows a partial cross-sectional view at a forward bulkhead of the rebuilt tanker 10 of FIGS. 4 and 5 looking forward. Basically, the same method described heretofore is applicable for the forward-most and aft-most bulkheads for the entire cargo length. As shown in FIG. 7, the modified or rebuilt bulkhead 60 includes the existing transverse bulkhead 61, the new bottom filler piece 62, the new side filler piece 63, the existing turn of the bilge 18, the existing topside deck plating 21, the new topside deck plating 21*a*, the existing outer bottom hull 14, the existing inner side hull 16, the new inner bottom hull 15, and the new outer side hull 17.

FIGS. 8–15 show a partial cross-section of an exemplary tanker and illustrate an exemplary process of rebuilding an existing single hull tanker 1 into a rebuilt double hull tanker 10.

Normally, the vessel will be gas freed, cleared for hot work and dry-docked prior to commencement of the process of rebuilding an existing single hull tanker into a rebuilt double hull tanker. The tanks will be cleaned of all residual debris, and the appropriate set-up, staging and the like will be installed as required for the double hulling process. Typically, this would include lighting, access holes in way of the bottom, working platforms, etc. Preferably, the removed steel is reused whenever possible. Alternatively, the items identified to be reinstalled may be renewed with new steel. The items to be removed will be identified, as well as the items to be removed and reinstalled.

Figure 8:
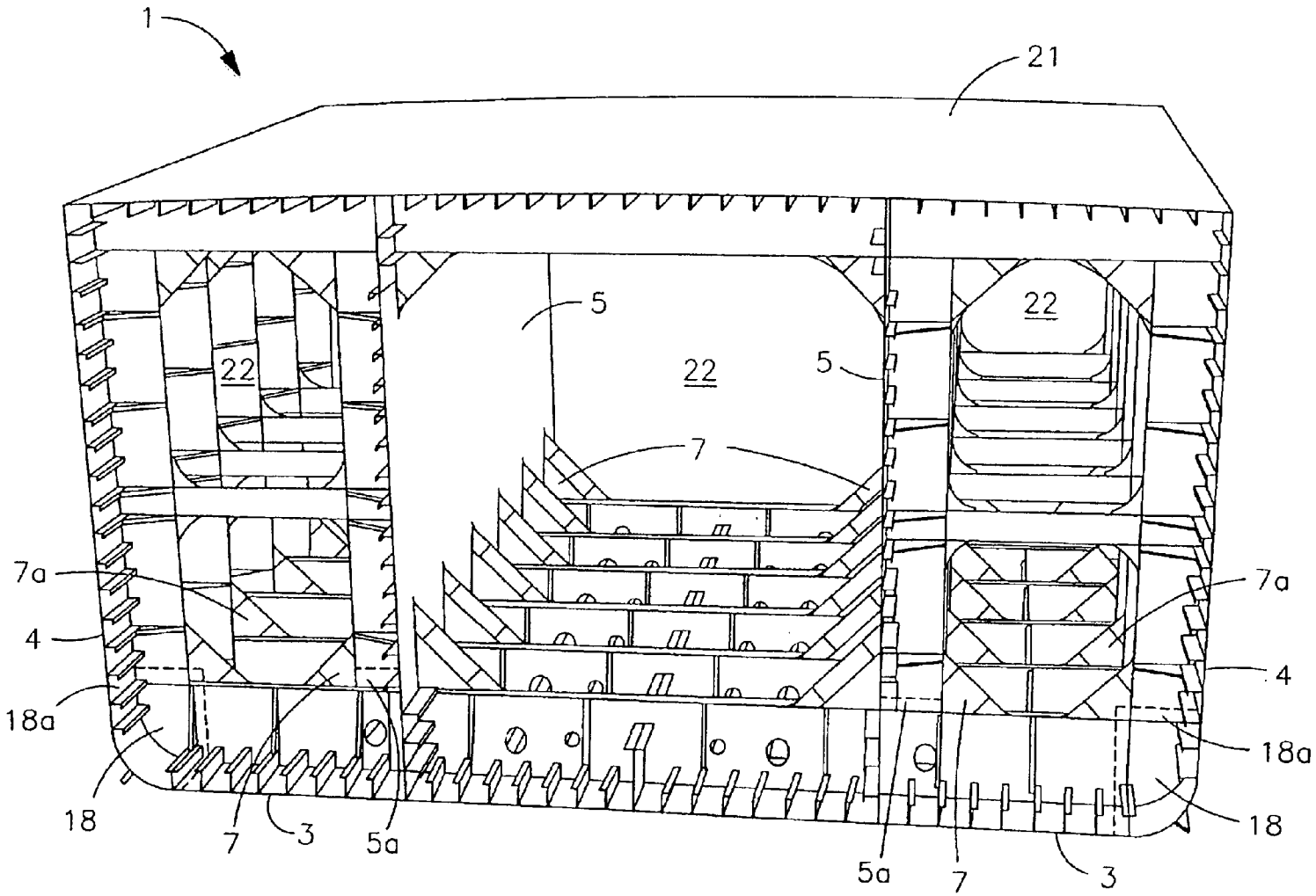
FIG. 8 shows an exemplary single hull tanker illustrating the existing structure that will be cut-out in accordance with one embodiment of the present invention.
Figure 9:
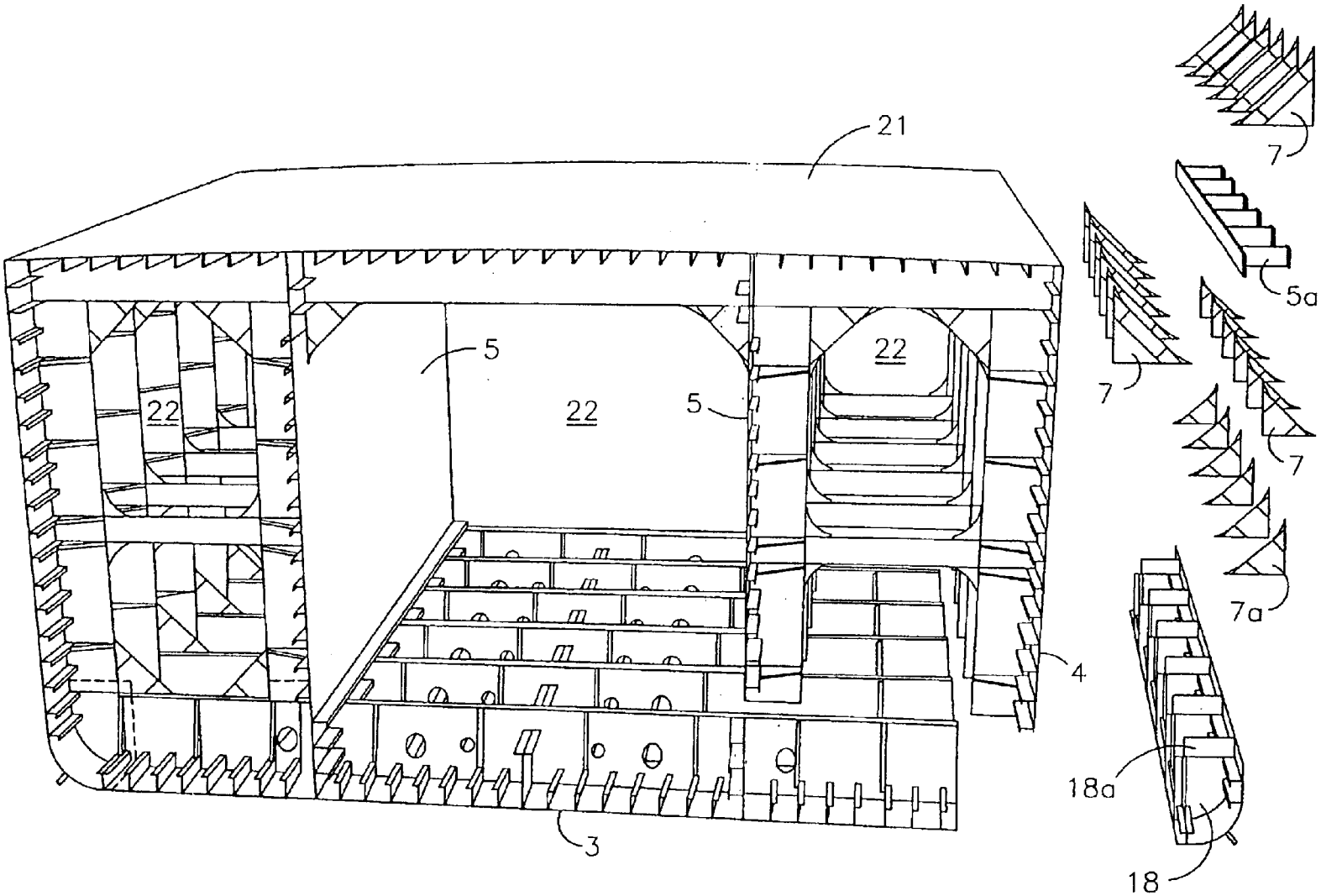
FIG. 9 shows the exemplary tanker of FIG. 8 with the cut-out structure removed from a first side and center area of the existing single hull to allow installation of the new inner bottom hull.

As shown in FIGS. 8 and 9, cutting can begin once the tanker is ready for hot work. The first item to be cutout is the turn of the bilge 18 and can include a small section of the bottom plating (not shown) and/or the side shell 18*a* immediately adjacent to the turn of the bilge. The turn of the bilge 18 will be set aside and preferably reinstalled at a later time. One of the benefits to reusing this piece is that is saves the bilge keel as well as the turn of the bilge. Since the turn of the bilge 18 is a shaped piece it is more expensive to install than flat plate and there is a significant cost savings realized in reusing this piece. In addition, a good deal of welding is saved from preserving the bilge keel. The outboard most brackets 7*a* that formerly stiffened the side shell vertical web frame can be removed and discarded. Due to the nature of the new side shell installation these brackets are no longer required.

The removal of the turn of the bilge 18, a lower portion 5*a* of the longitudinal bulkhead 5, and associated brackets 7 forms access ports 80 through the outer side shell 4 and access apertures 80*a* through the longitudinal bulkheads 5. The access ports 80 and access apertures 80*a* provide access to the cargo holds 22 through the side of the tanker. Preferably, the removal of structure 18, 18*a*, 5*a*, 7, 7*a* and formation of access ports 80 and access apertures 80*a* is affected on either the port side or starboard side at one time, in way of one hold. FIG. 9 shows the turn of the bilge 18, the lower portion 5*a* of longitudinal bulkhead, brackets 7, and brackets 7*a* removed from one side at a time. The integrity of the opposite side of the tanker is preferably kept intact to maintain the structural strength of the tanker.

In embodiments where the tanker to be rebuilt includes multiple cargo holds, the new inner bottom hull 15 can be installed simultaneously in more than one cargo hold with adjacent cargo holds being worked from alternative port and starboard sides of the tanker in order to retain structural integrity and sufficient strength during the installation process of the new inner bottom hull 15.

Figure 10A:
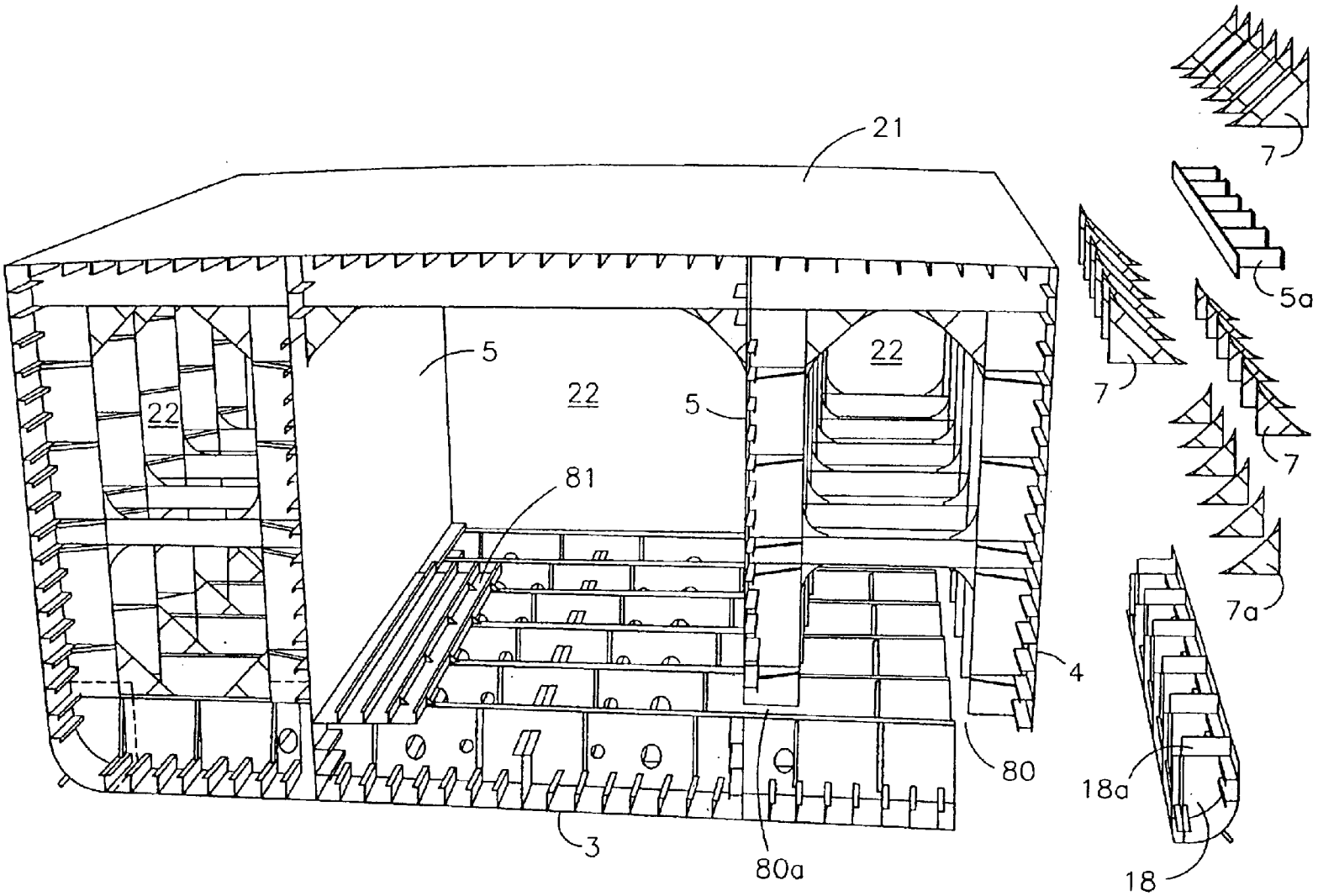
FIGS. 10A–10C show the installation of the new inner hull, the longitudinal bulkhead renewed, and re-installation of support brackets.
Figure 10B:
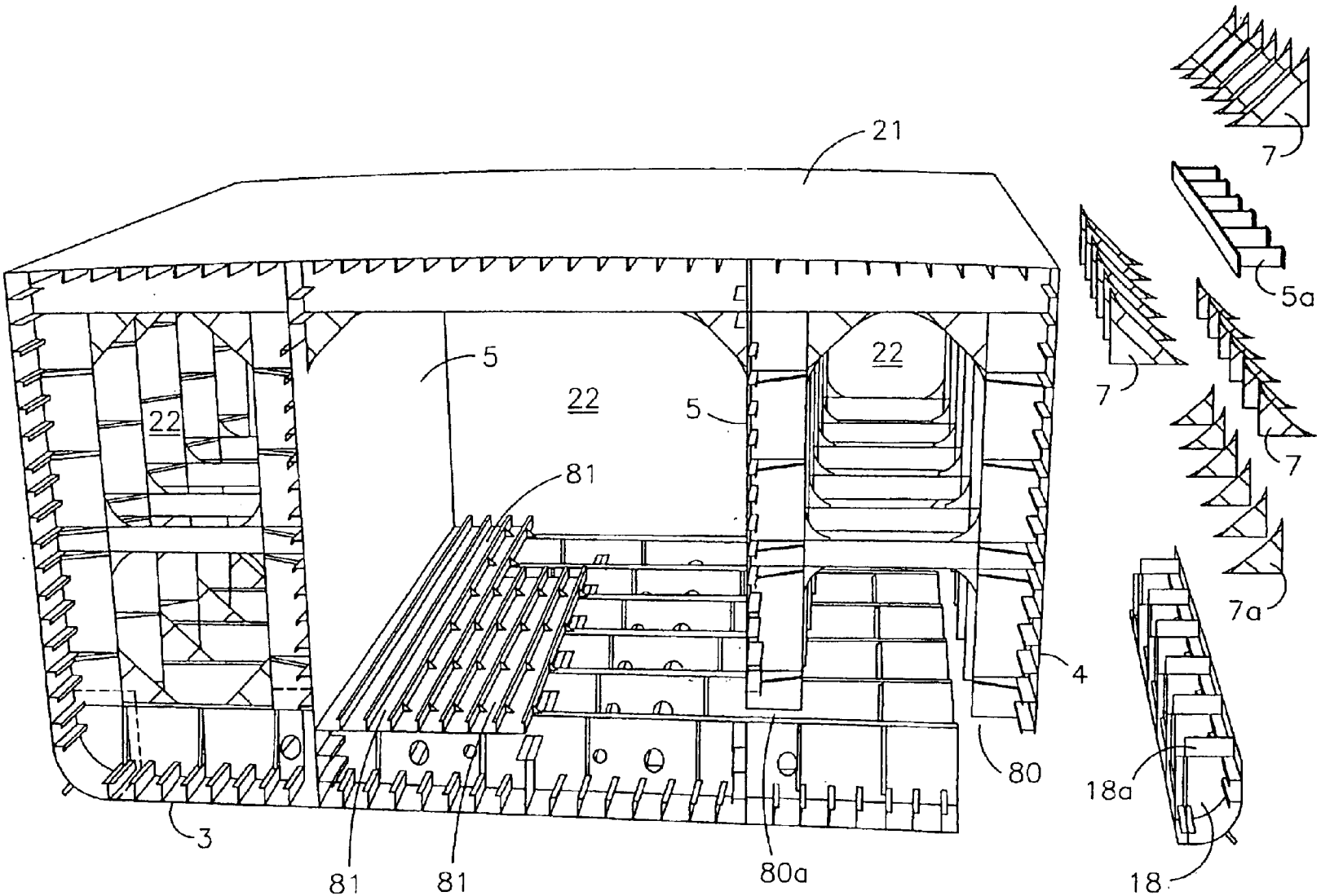
Figure 10C:
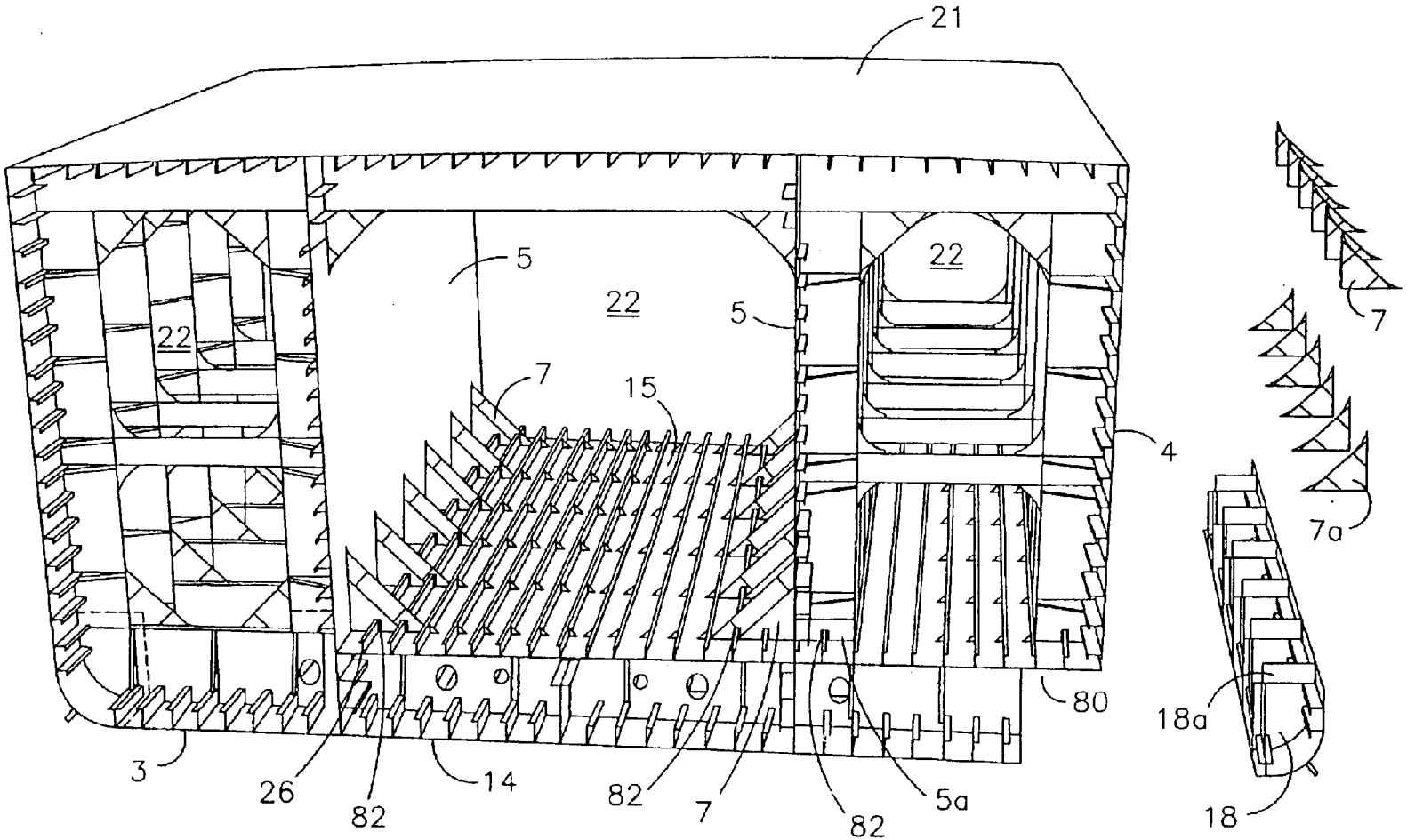

As shown in FIGS. 10A–10C, once the access ports 80 and access apertures 80*a* are open, the material for the new inner bottom hull 15 can be installed. Preferably, the new inner bottom hull 15 is prefabricated off-site of the actual rebuild to save time and also is fabricated in a plurality of sections to facilitate installation of the new structure through the access ports 80 and/or the access apertures 80*a*.

In one embodiment, a plurality of stiffened panels are prefabricated on a jig in a shop that allows for a faster, better fit-up and weld procedure than could be accomplished in place. In the illustrated embodiment, the panels 81 include a length and width comprising common size plates and sized to fit through the access ports 80. The number and size of the panels 81 will depend on the particular application and the size of the tanker that is being rebuilt. The appropriate number and size panels are slid in place through the access ports 80 and/or access apertures 80*a* to complete the new inner bottom hull 15 from one transverse bulkhead (not shown) to the next transverse bulkhead (not shown). The size (e.g., length and/or width) of the panels 81 may be changed, and if standard size plates are not available, then the plate can be fabricate as desired on, for example, a special millrun. In another embodiment, the overall size of the panels 81 can also be increase in order to reduce the number of longitudinal butt seams required.

FIGS. 10B and 10C show the continuation of the installation of the new inner bottom hull 15. FIG. 10B shows a second panel 81 being installed. One or more panels 81 are installed until the floor is closed in the fore and aft and the transverse directions. As shown, the new inner bottom work can progress towards the side shell 4.

FIG. 10B shows the inner bottom hull 15 partially completed. During this process the brackets 7, which support the far side longitudinal bulkhead 5, can be fitted and installed. As can be seen by the illustration, the brackets 7 preferably have cutouts 82 to allow for the passage and support of the inner bottom longitudinal 26. Preferably, these cutouts 82 are done during the initial phases when the brackets 7 are cut-out and removed, such that the brackets 7 are immediately ready to be installed. At the original side shell 4 the inner bottom 15 should be scribed and fit such that the new extension of the longitudinal bulkhead can be placed.

FIG. 10C shows the inner bottom hull 15 partially completed all the way up to the side shell 4. The longitudinal bulkhead 5 is completely renewed and the remainder of the bracketing 7 is installed. Preferably, the longitudinal bulkhead 5 is renewed using the same lower portion 5*a* that was previously removed. As with the brackets 7 installed on the far longitudinal bulkhead, the new brackets 7 should be fitted with cutouts 82 to allow the passage and support of the inner bottom longitudinals 26.

Figure 11A:
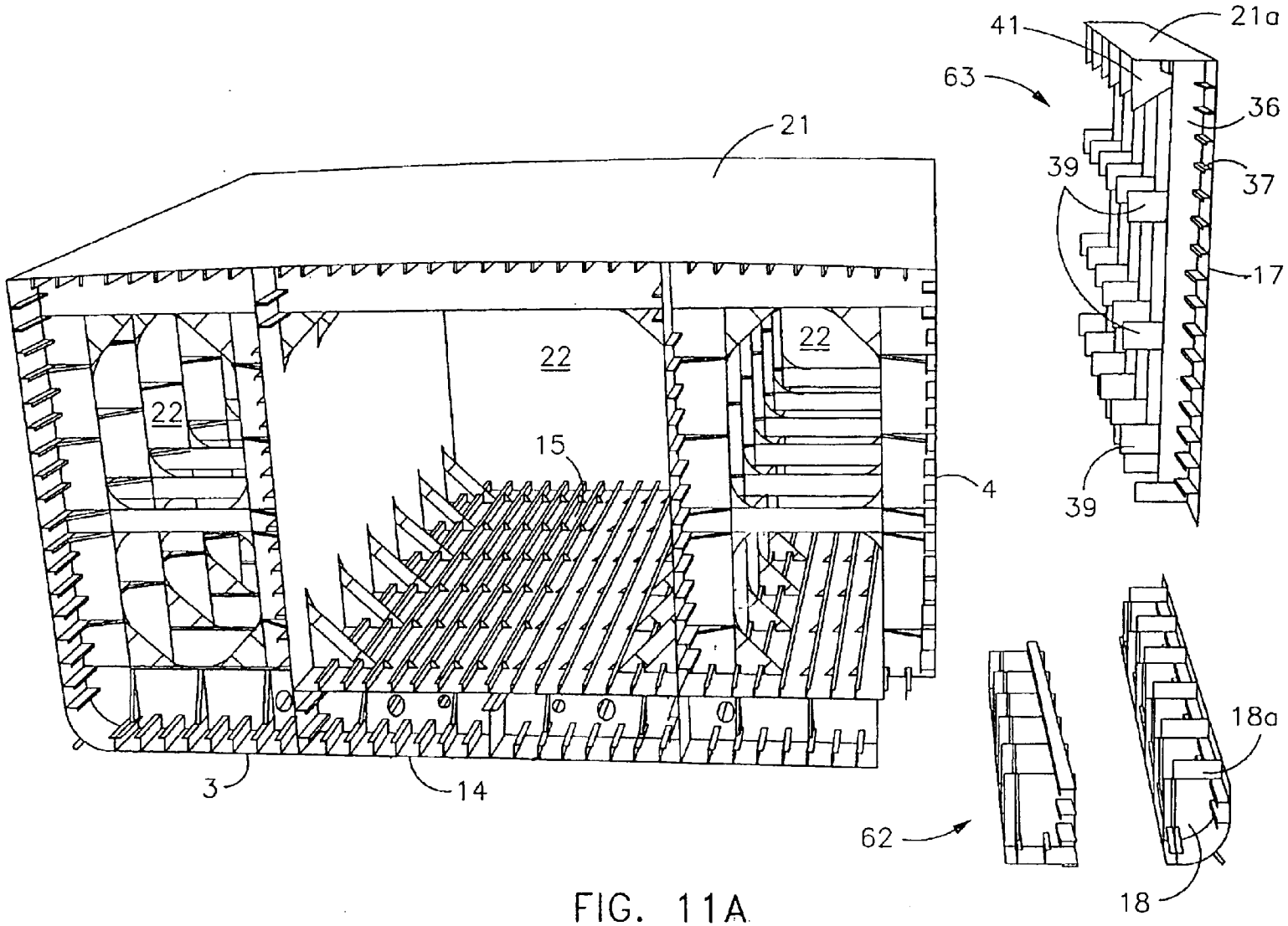
FIGS. 11A–11C show the installation of the new bottom pieces, reinstallation of the turn of the bilge, and installation of the new outer side shell.
Figure 11B:
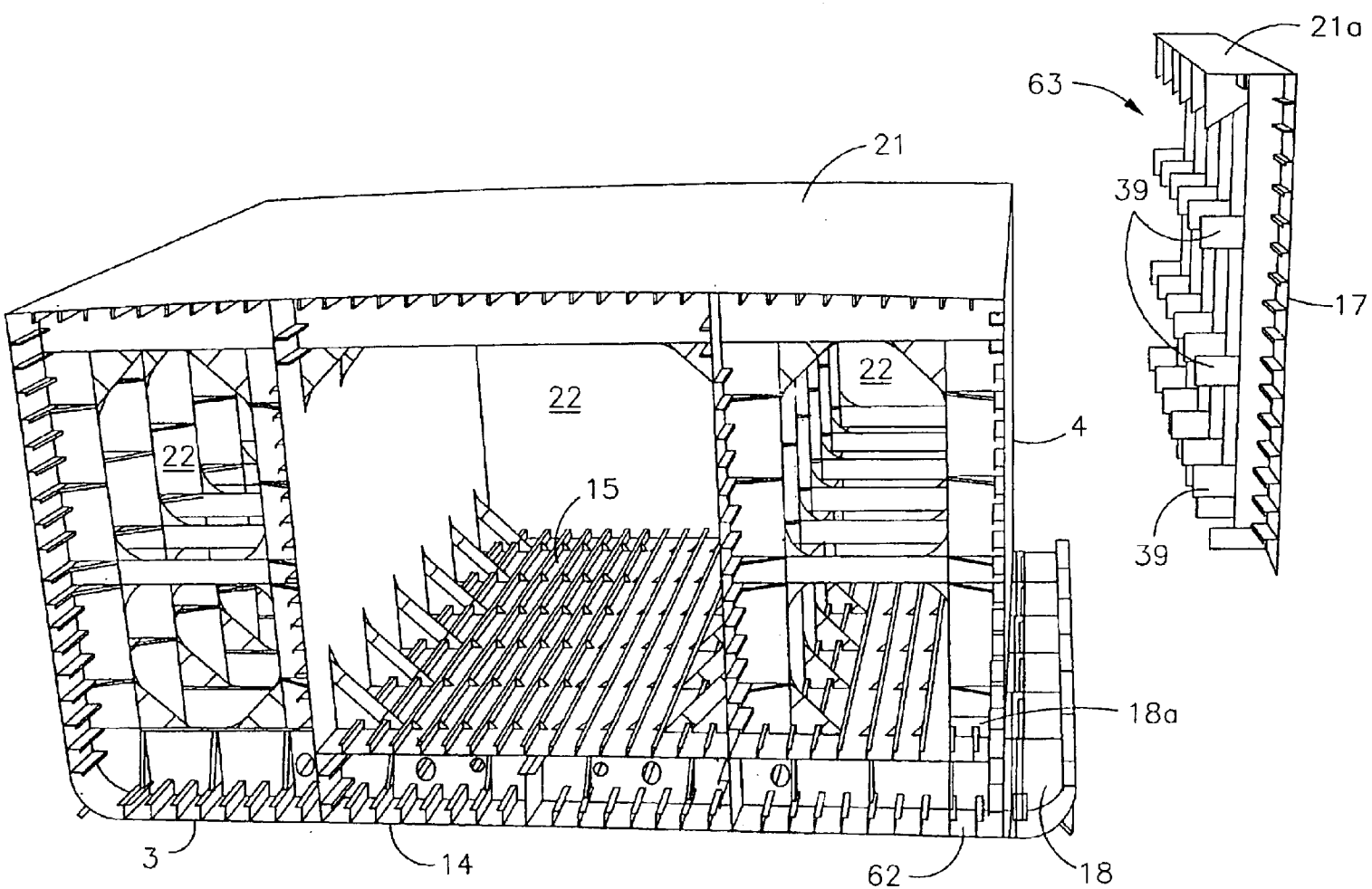

FIGS. 11A and 11B show the installation of the new bottom filler piece 62. New bottom filler piece 62 includes plating and associated transverse and longitudinal stiffening members. This piece will be scribed in such that it matches the existing vessel's bottom plating, including any dead rise, and is directly supporting the former side shell 4 which has become the new longitudinal bulkhead between the cargo and the ballast tanks. After the bottom filler piece 62 is fit up to the existing structure it will be welded out such that the turn of the bilge 18 can be reinstalled.

Figure 11C:
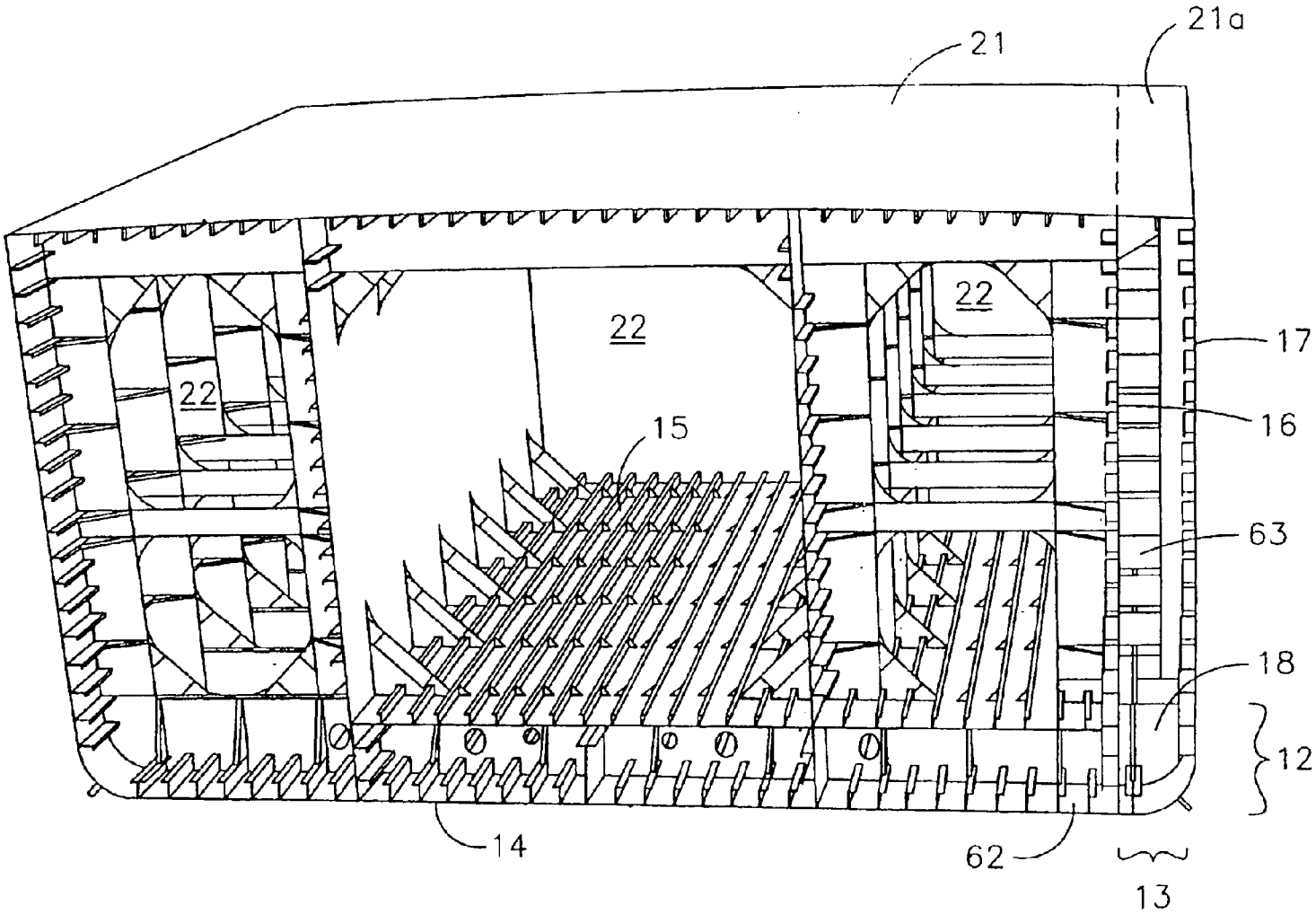

FIGS. 11A–11C illustrate an exemplary process of installing the new outer side hull 17 to the exterior of the existing side shell 4, which forms the existing inner side hull 16. As shown, the original turn of the bilge 18 is scribed in and fit up to the newly inserted bottom filler piece 62. An insert 18*a* is used to close-up the access holes 80 in the inner side hull 16. Preferably, the insert comprises the portion of the outer side shell 18*a* that was removed above the turn of the bilge 18 or, alternatively, new steel may be installed in way of the access hole 80.

As shown in FIG. 11B, once the turn of the bilge 18 is in place the new outer side filler piece 63 and the turn of the bilge 18 must be scribed and fit-up for a good fit at the new outer side shell 17 and the frames. The new outer side filler piece 63 includes the new outer side hull plating 35, connecting plates 39, and transverse and longitudinal stiffeners 36, 37.

FIG. 11C shows the new outer side filler piece 63 and outer side hull 17 connected over the exterior of the existing side shell 4, which again forms the existing inner side hull 16 of the new double side hull 13. As shown in FIG. 11C, the outer side filler piece 63 is installed through the use of connecting plates 39.

In one embodiment, the connecting plates 39 are butt into the original side shell 4 in way of a supporting web frame 28. In one embodiment, the connecting plates 39 connect to the new structure by lapping on the face of the new vertical side shell stiffener 36. This butt and lapping technique is preferred because it allows a great deal of latitude in fit up in that the existing and new structure can be offset within a specified range which aids in modular type construction. This technique provides easily accessed on the connection for welding. Another benefit of the connecting plates 39 is that they can be set to dramatically reduce the vertical side shell stiffener span. The span reduction allows the vertical stiffener of the new side pieces 63 to be smaller than the previous vertical side shell stiffener. The main deck can be simply scribed out to match the contour of the shear strake and then fit up and welded out top and bottom.

Once the rebuild of one side of the tanker is completed, the rebuild of the opposite side of the tanker can begin. As explained previously, both sides of the tanker should not be worked at the same time. The process is very similar, the only difference being that the longitudinal bulkhead does not need to be cut. In order to maintain longitudinal structural integrity, it is preferred that the side shell on one side remain intact at all times while the opposite side is being rebuilt. Therefore, one side should be completely finished before work on the other side begins. As was also stated above, it is also preferred that no cargo hold have the next forward or next aft hold being accessed on the same side at the same time. The process is preferably staggered to prevent structural problems. In other embodiments, multiple adjacent cargo hulls can be worked simultaneously provided that adjacent cargo holds are accessed from opposite sides of the tanker.

Figure 12:
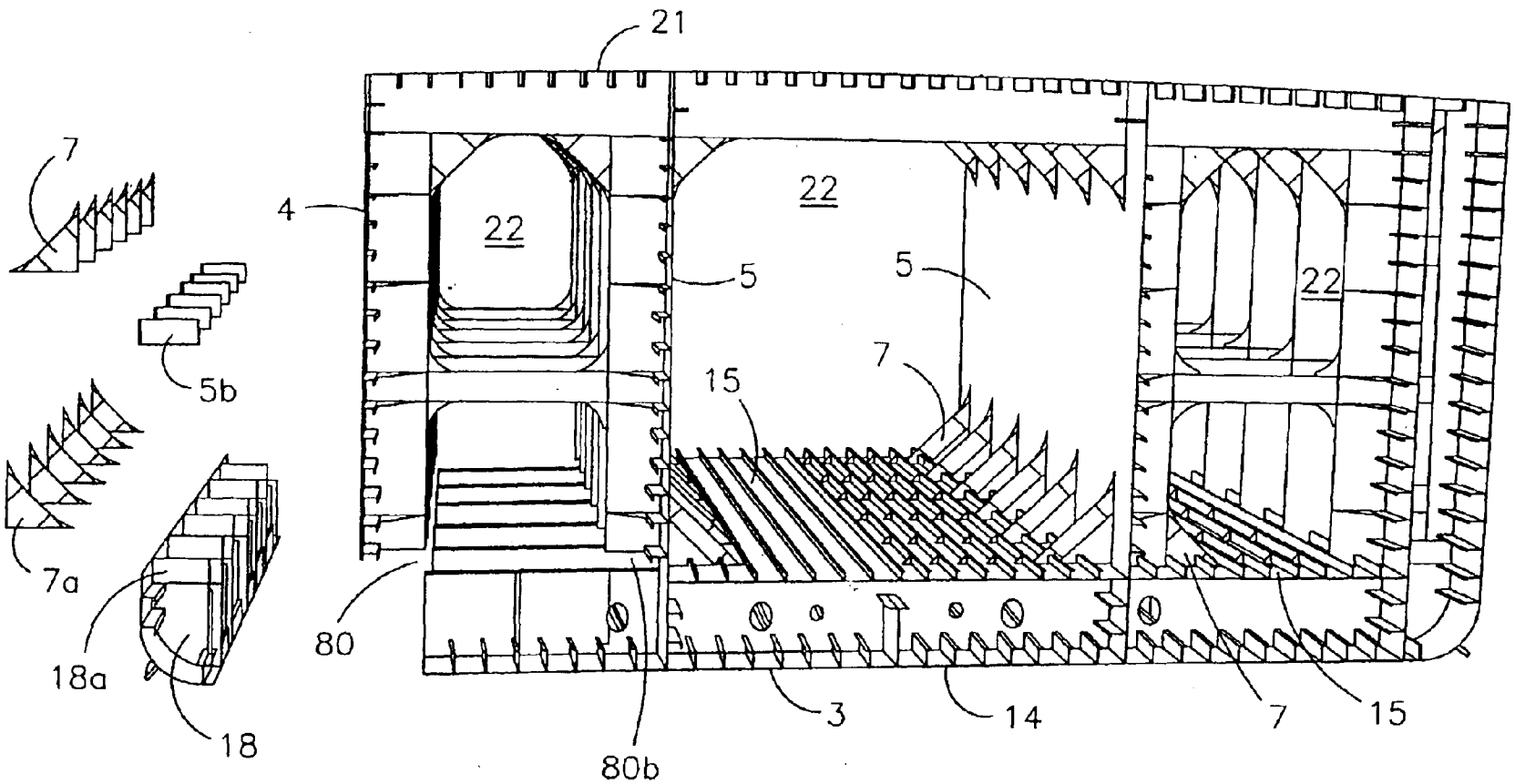
FIG. 12 shows the exemplary tanker of FIG. 8 with the cut-out structure removed from the other side of the existing single hull to allow installation of the new inner bottom hull.

FIG. 12 shows the tanker rebuild process being performed on the second or opposite side of the tanker. As shown in FIG. 12, the turn of the bilge 18 is removed to form access ports 80. The existing bracketing 7 is then removed through the access ports 80. A lower portion of the longitudinal bulkhead stiffener members 5*b* is removed in way of the inner bottom to form access apertures 80*b* to allow for the installation of the new inner bottom hull 15, including the inner hull plating 25 and stiffeners 26.

Figure 13A:
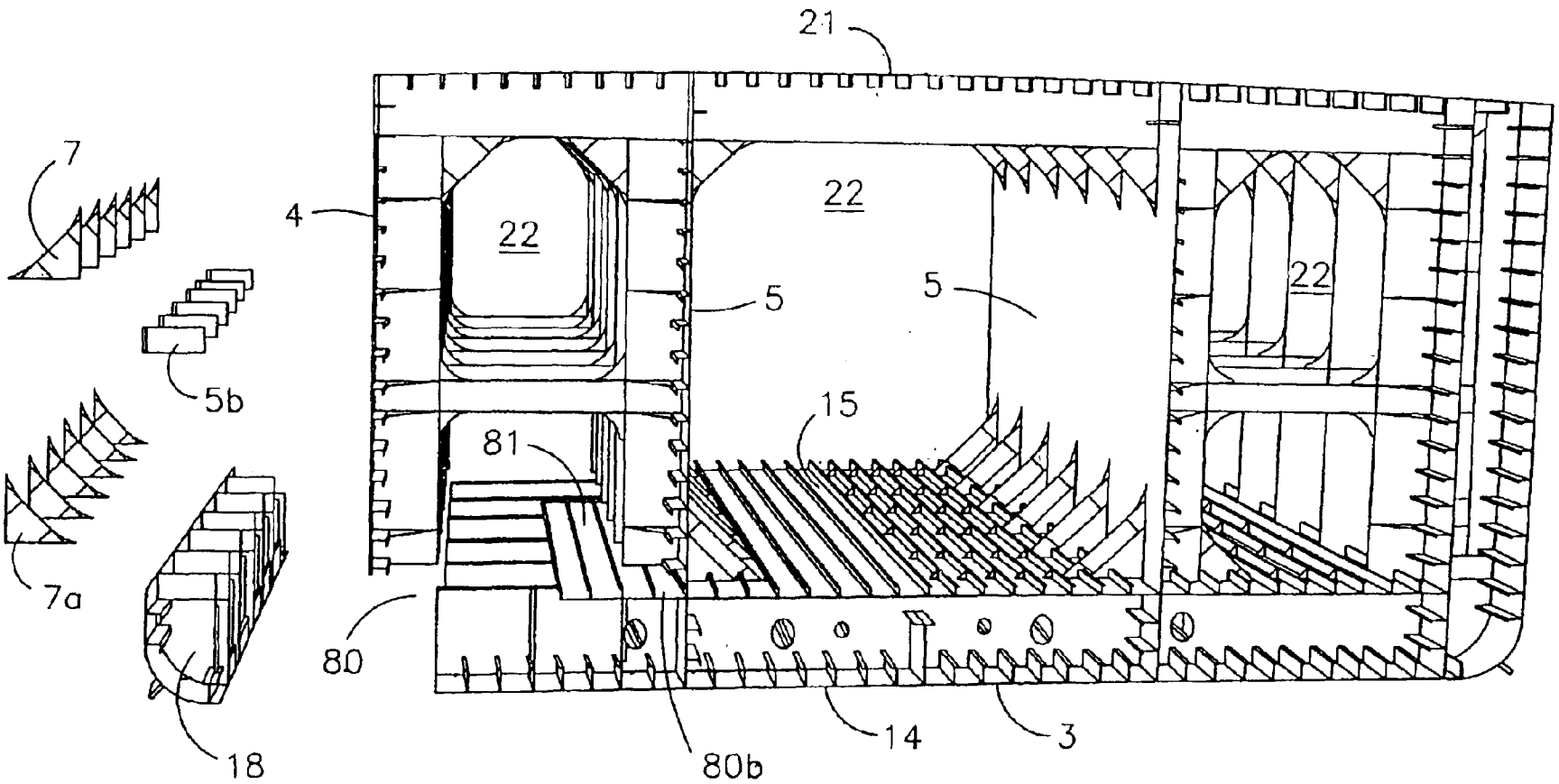
FIGS. 13A–13B show the installation of the new inner hull, the longitudinal bulkhead renewed, and re-installation of support brackets.
Figure 13B:
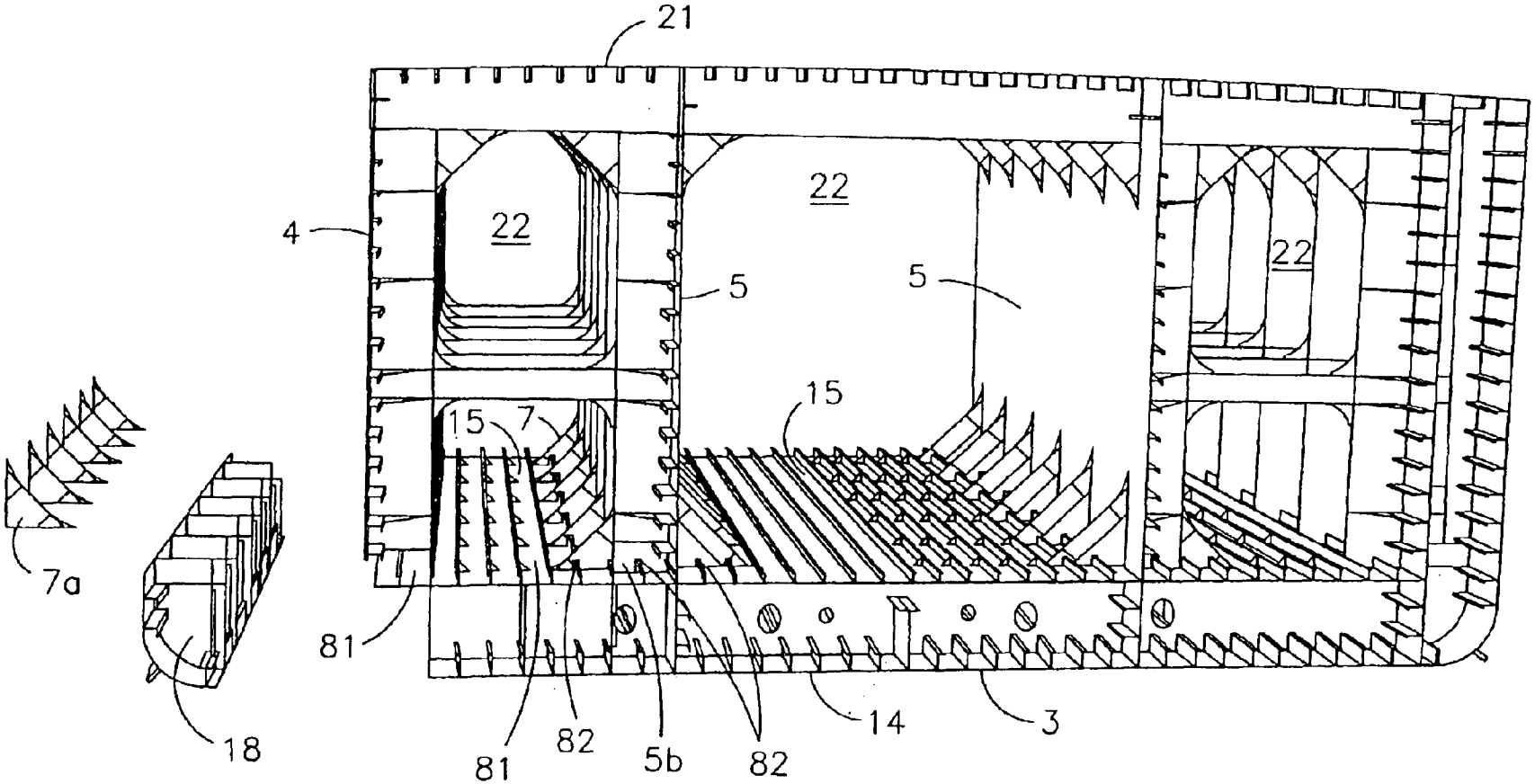

FIGS. 13A and 13B show the installation process on the opposite side. Preferably, the new inner hull 15 is installed as a plurality of plates 81, each having an appropriate size to allow ease of installation and to minimize the amount of welding to attach the plates 81 to the existing structure. FIG. 13B shows the remainder of the new inner bottom hull 15 completely installed and welded out on the second side. The stiffener for the longitudinal bulkhead 5 is renewed. The lower portion of the longitudinal bulkhead stiffener members 5*b* and the brackets 7 should be prepared such that the cutouts 82 are ready and the pieces are ready to be welded out.

Figure 14A:
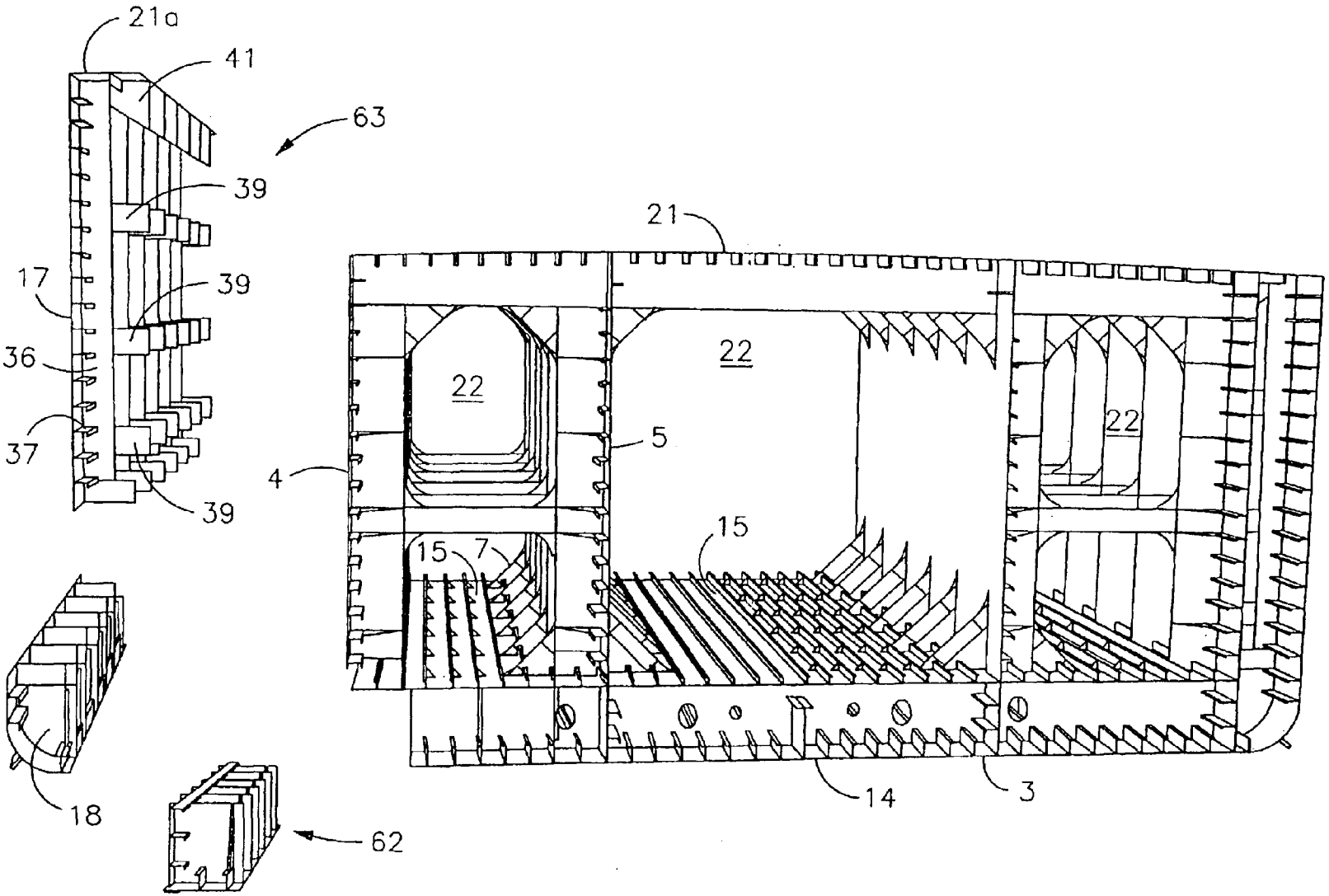
FIGS. 14A–14C show the installation of the new bottom pieces, reinstallation of the turn of the bilge, and installation of the new outer side shell.
Figure 14B:
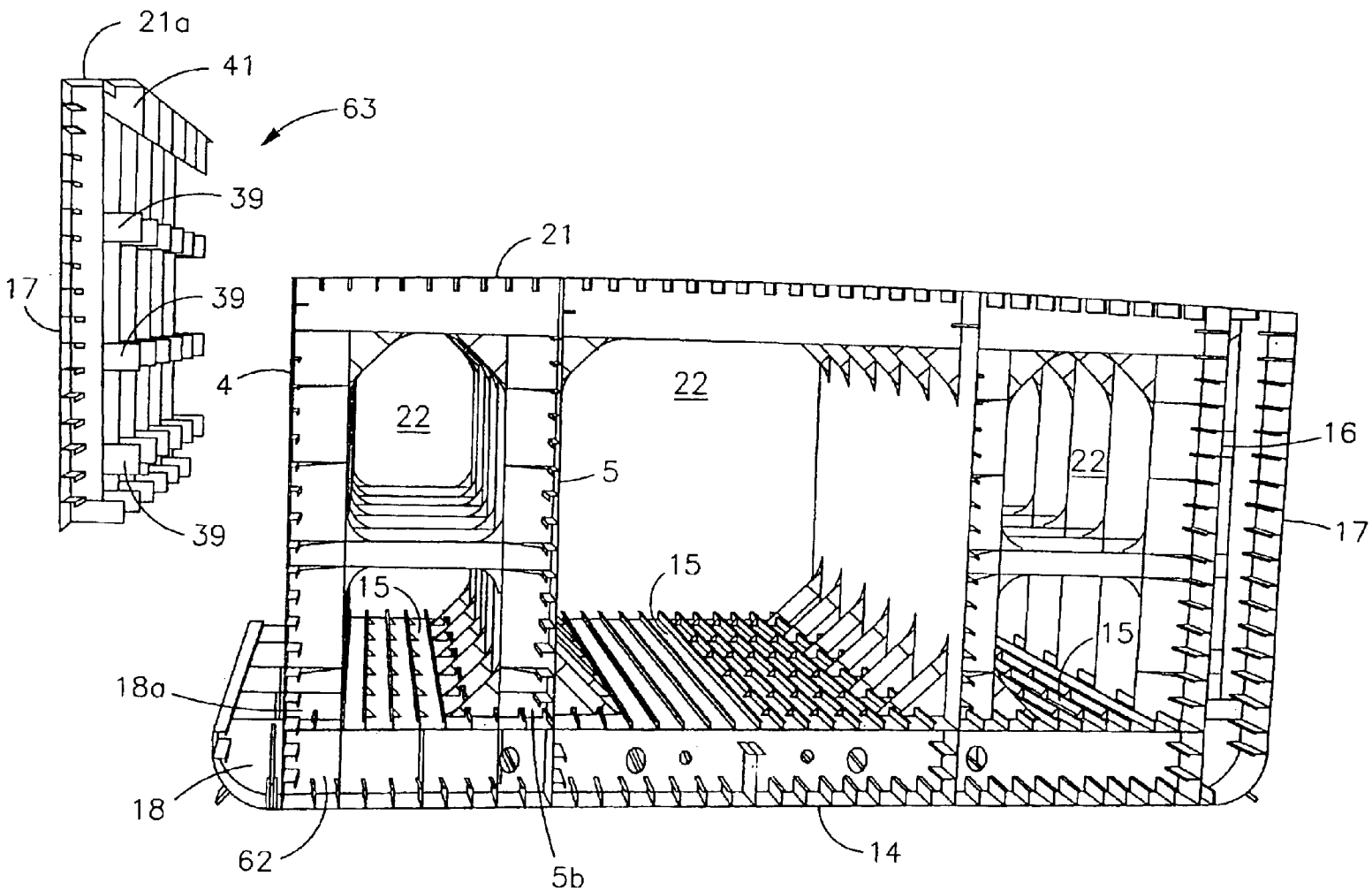
Figure 14C:
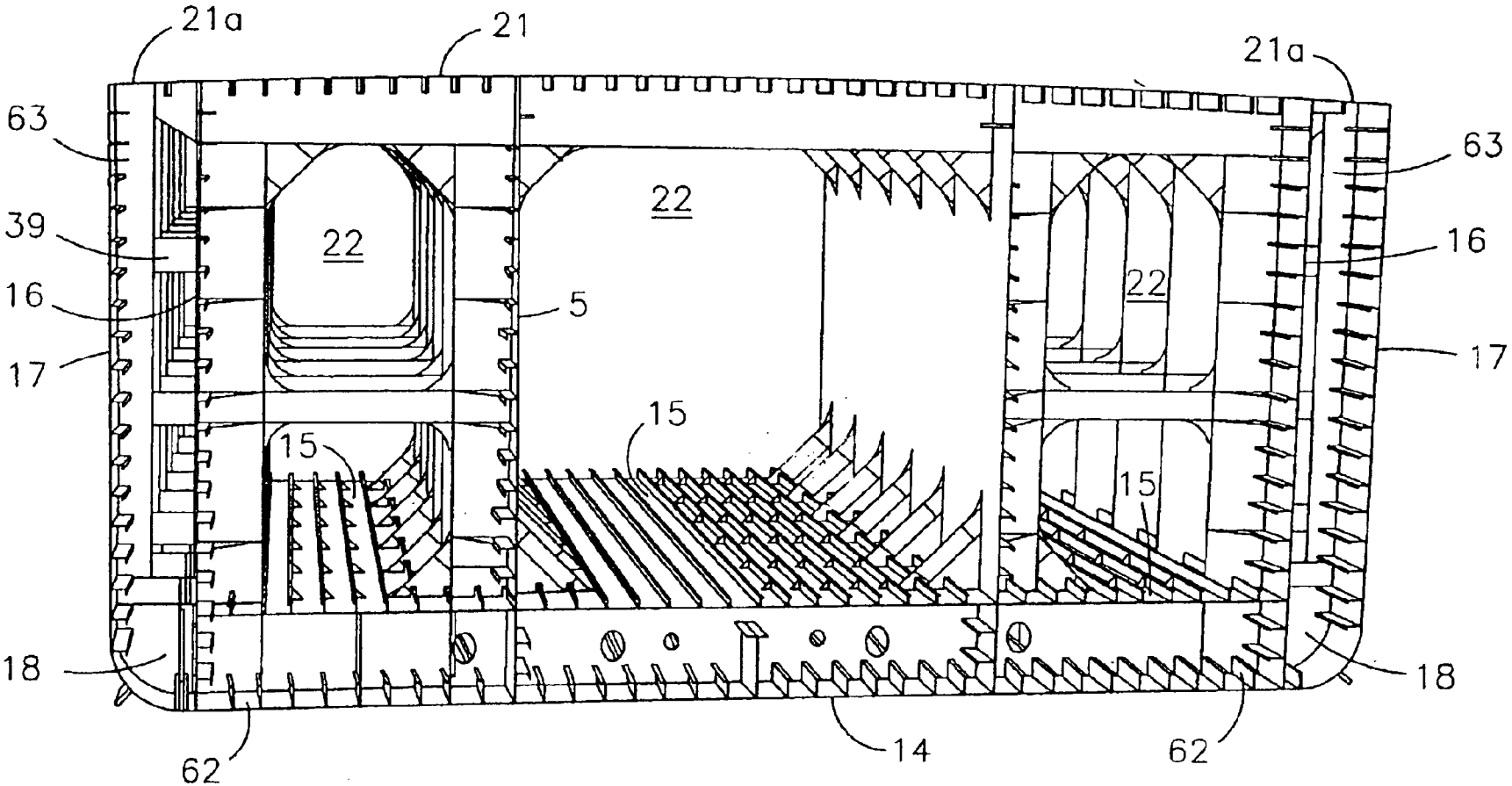

FIG. 14A–14C show the installation of a new bottom filler piece 62, similar to the opposite side, in way of the double bottom hull, reinstallation of the turn of the bilge 18, and installation of the new side filler piece 63. Preferably, the original turn of the bilge 18 is renewed and reinstalled. The new outer side filler piece 63 including outer side hull 17 is landed and welded out as was done on the opposite side. Brackets 7*a* can be scrapped as they are no longer needed in the double hull structure.

Figure 15:
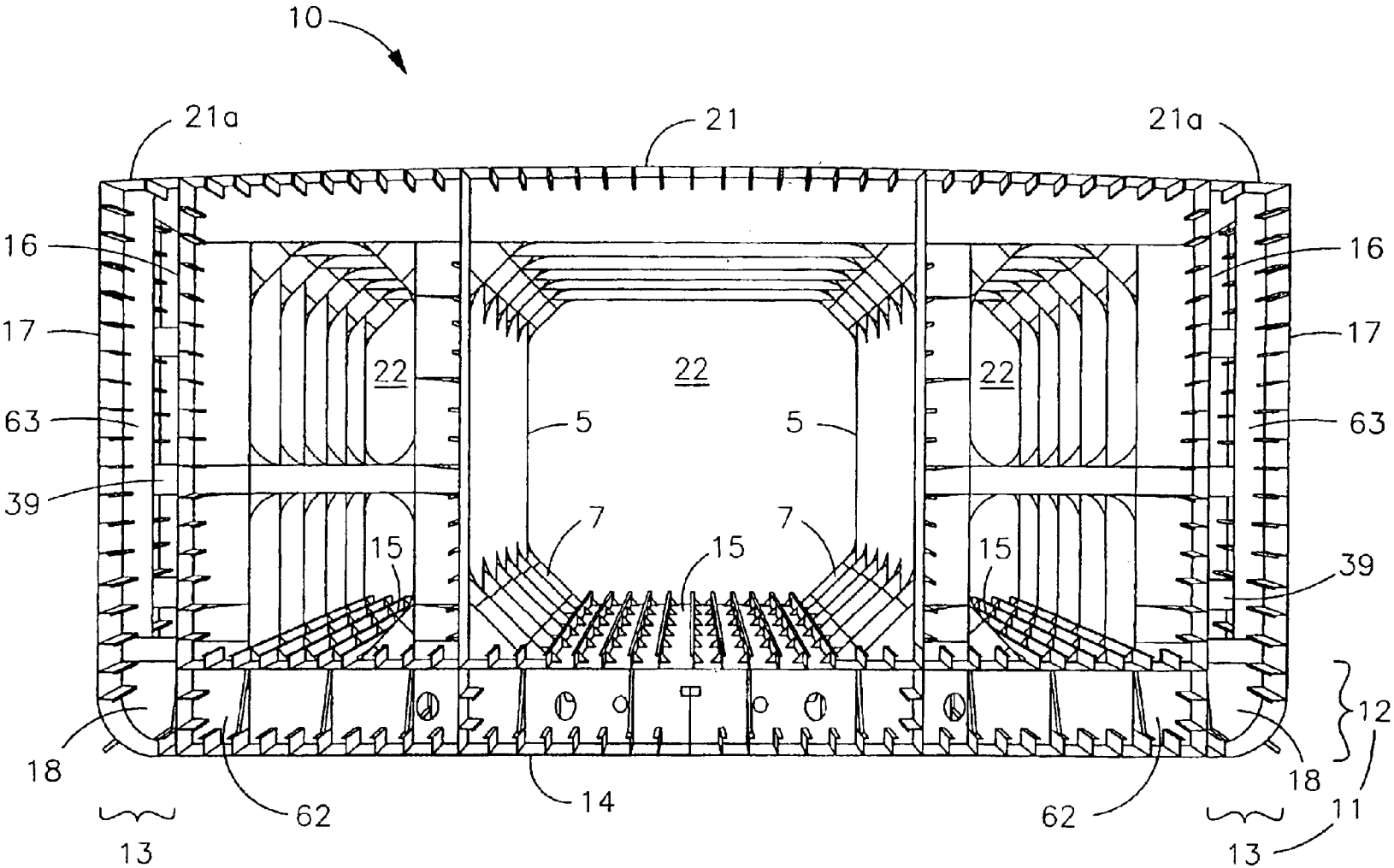
FIG. 15 shows the rebuilt double hull in accordance with one embodiment of the present invention.

FIG. 15 shows the complete section of the rebuilt double hull tanker 10 having a new inner hull 15 over the interior of the existing outer hull 14 to form the new double bottom hull 12 and having a new outer side hull 17 installed over the exterior of the existing inner side hull 16 to form the new double side hull 13. The combination of the new double bottom hull 12 and the new double side hulls 13 form a continuous double hull 11 of the rebuilt tanker 10. The rebuilt double hull tanker 10 is completed and the tanker is ready for service as a double-hulled petroleum carrier.

Typically, the expense of the double hull rebuild increases with the length of time that the tanker must be out of the water and in a graving or dry dock. Therefore, in alternate embodiments it may be desirable to reduce the amount of time that the tanker to be double hulled is in the graving dock or dry dock. Also, the availability and characteristics of a particular graving or dry dock are factors that are typically considered in determining whether a particular graving or dry dock is a suitable for the double hull rebuild of a particular tanker and also which shipyard or repair facility is capable of performing the double hull rebuild. For example, the size of the tanker to be rebuilt in relation to the available graving or dry dock may limit the shipyards and repair facilities that have suitable graving or dry dock facilities to satisfactorily perform the double hull rebuild and may also limit the process used to perform the double hull rebuild.

One method of reducing the time that the tanker is out of the water and that a graving or dry dock is tied up is to install a portion, or all, of the new double bottom hull 15 through the topside decking 21 while the tanker is still afloat. Other advantages of this alternate method is that it reduces the amount of structure that otherwise would be cut-out and removed and then later re-installed. For example, this alternative method of installing the new inner bottom hull 15 through the topside decking 21 allows the bulkheads 5 to remain whole and also eliminates the need of having to cut-out the existing support brackets 7 (such as shown, for example, in FIGS. 10A–10C). By installing the new inner bottom hull 15 through the topside decking 21, existing structure 5*a*, 7 can be left in place and the new inner bottom hull 15 can be dropped in around the bulkheads 5 and support brackets 7.

Figure 16:
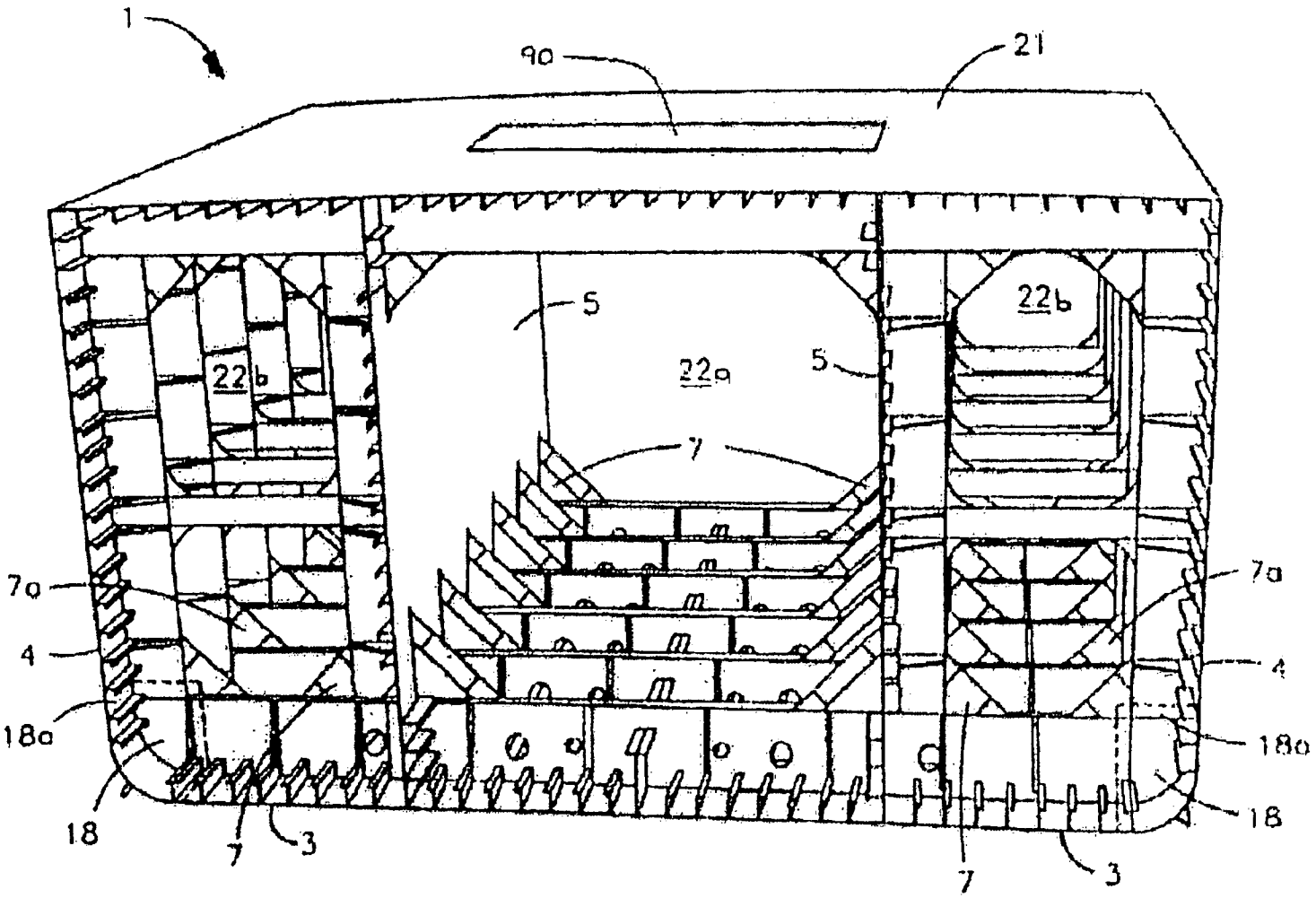
FIG. 16 shows a cross-sectional view of an exemplary single hull tanker illustrating a cut-out in the topside deck plating for insertion of the new inner bottom hull in accordance with another embodiment of the present invention.

FIG. 16 shows another exemplary embodiment illustrating a temporary cut-out 90 in the topside decking 21 for insertion of at least a portion of the new inner bottom hull 15. As shown, the existing single hull tanker includes a center cargo tank 22*a* and side cargo or wing tanks 22*b*. Preferably, at least a center portion of the new inner bottom hull 15 is installed through the topside decking 21 over the center cargo tank(s) 22*a*. A cut-out is formed in the topside deck plating having a width and length sufficient to allow the new inner bottom hull 15 to be installed in one or more sections, such as panels 81.

Preferably, the cut-out 90 in the topside decking 21 is made at a location so as to minimize the disruption of existing machinery and/or piping. As shown in FIG. 16, the cut-out 90 is oriented athwartship, but it is contemplated that the cut-out 90 could be oriented having its length running fore and aft, or any other direction that helps to minimizes the disruption of existing machinery and/or piping.

Figure 17:
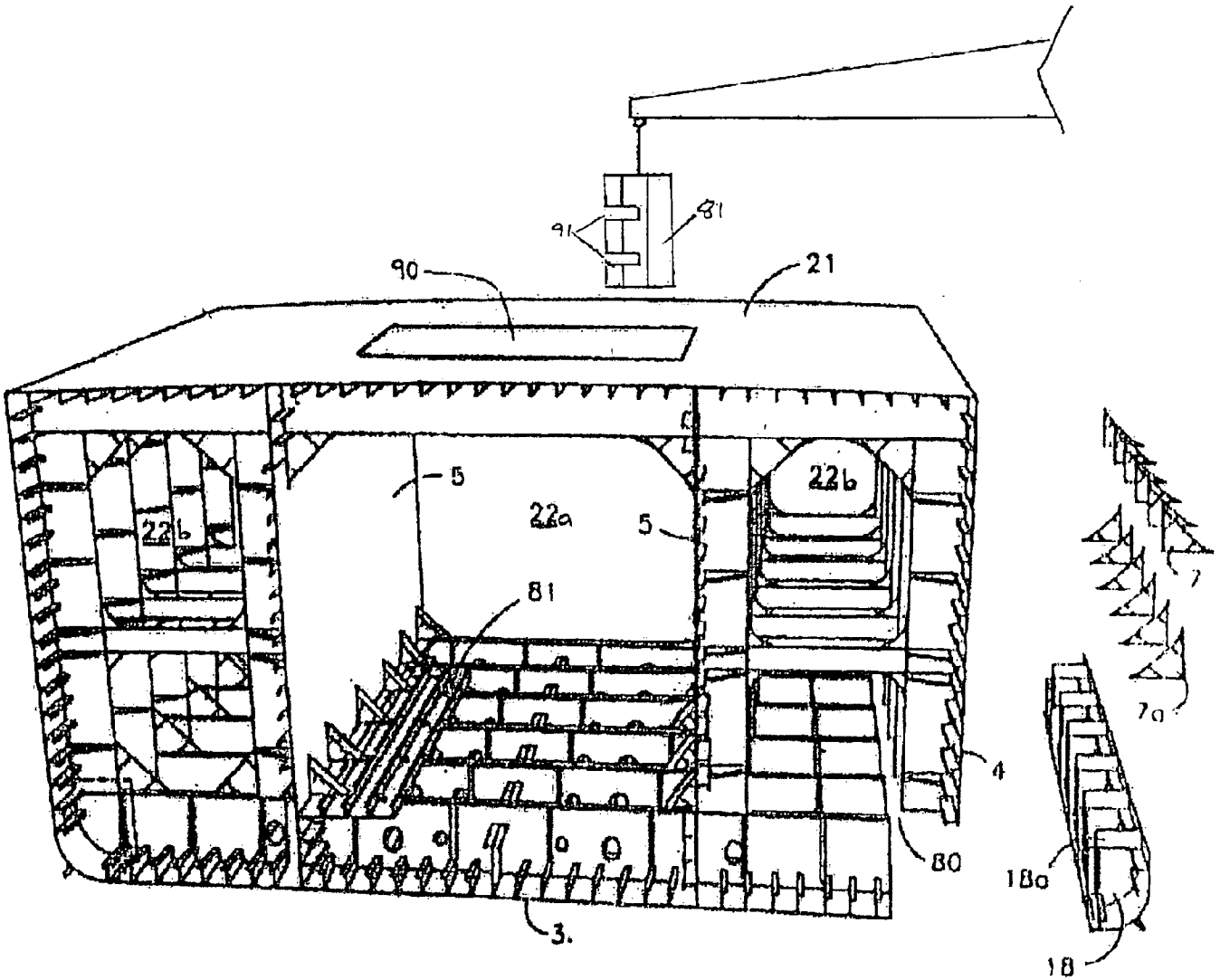
FIG. 17 shows the installation of the new inner bottom hull through a cut-out in the topside deck plating.

FIG. 17 shows the installation of the new inner bottom hull 15 through a cut-out 90 in the topside deck plating 21. As shown, one or more panels 81 are installed through the cut-out 90 in the topside decking 21 and is laid on top of the existing framing 28 and fitted around the existing support brackets 7. Slots 91 can be provided in the panels 81 in way of the existing support brackets 7. Any space (not shown) between the new inner bottom hull 15 and the support brackets 7 can be filled in with weld and/or a filler compound so there wouldn't be a place where a puddle could form.

Installing at least the portion of the new inner double hull 15 in at least the area of the center cargo tanks 22*a* eliminates the need to cut access apertures 80*a* in a lower portion of the longitudinal bulkheads 5 and thereby allows the structural integrity of the longitudinal bulkheads 5 to remain intact. Also, installing at least a portion of the new inner double hull 15 in the area of the center cargo tanks 22*a* can be accomplished while the tanker is still afloat thereby reducing the amount of time that the tanker needs to be in a graving or dry dock.

Figure 18:
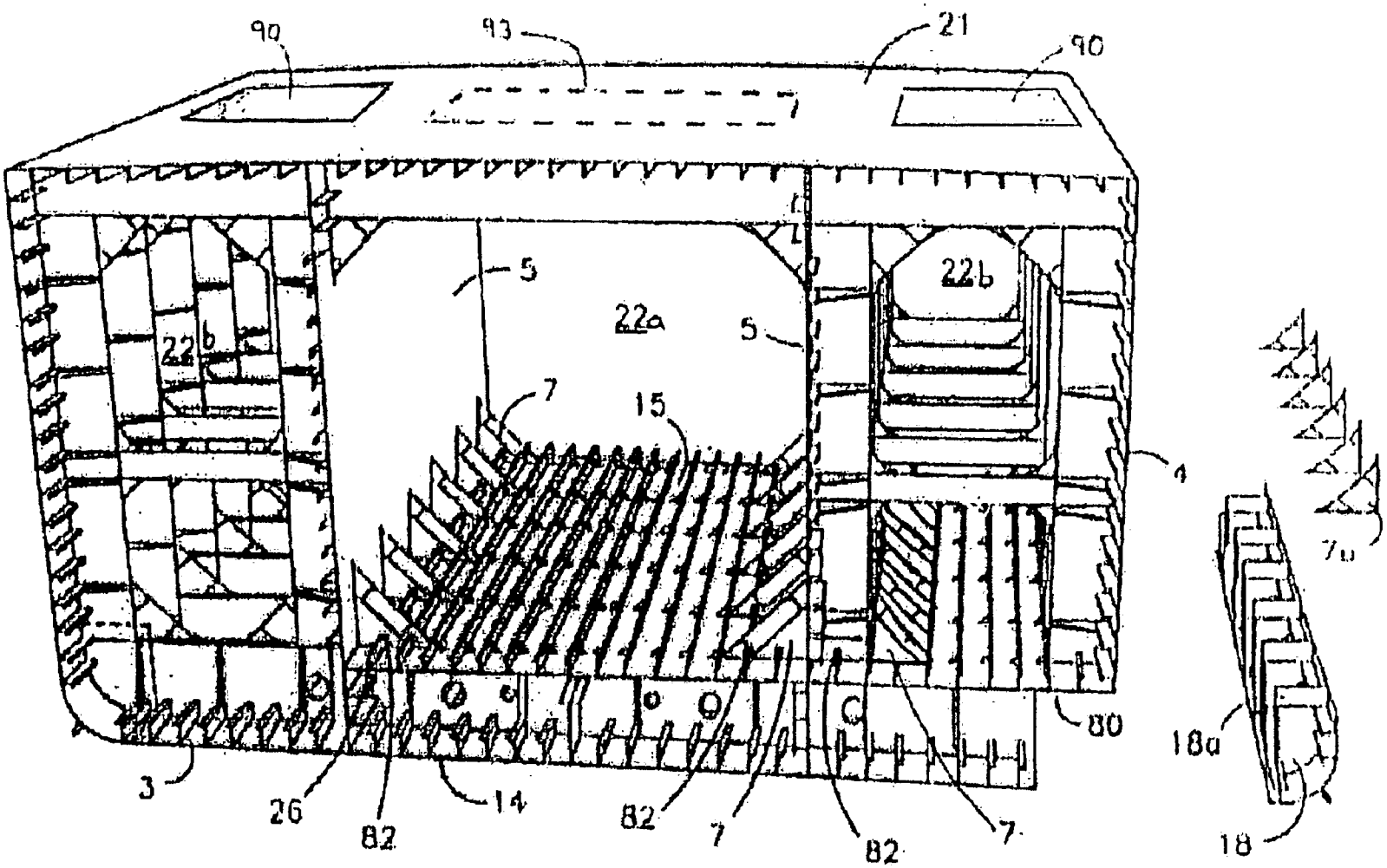
FIG. 18 shows the closing of the cut-out in the topside deck plating above the center cargo hull and options for installation of the new inner bottom hull in the wing tanks.

FIG. 18 shows the closing or renewing of the cut-out 90 in the topside deck plating 21 above the center cargo tank 22*a*. In addition, FIG. 18 shows options for installation of the new inner bottom hull 15 in the area of the wing tanks 22*b*. As shown in the embodiment of FIG. 18, temporary cut-outs 90 are made in the topside decking 21 above the port and starboard wing tanks 22*b* for insertion of a portion of the new inner bottom hull 15. The cut-outs 90 are formed in the topside deck plating 21 having a width and length sufficient to allow the new inner bottom hull 15 to be installed in one or more sections. Preferably, the cut-outs 90 in the topside decking 21 are made at locations so as to minimize the disruption of any existing machinery and/or piping.

Inserts 93 are used to close or renew the temporary cut-outs in the topside decking 21 after installation of the new inner bottom hull 15. Preferably, the cut-out sections of the existing topside deck plating are reused as the inserts.

Alternatively, since the turn of the bilge 18 is cut-out and removed regardless of the method of installing the new inner double bottom 15, the portion of the new double bottom 15 in the area of the port and starboard wing tanks 22*b* can be installed from the side of the tanker when the turn of the bilge is cut-out and moved outward to accommodates the new outer side hull 17. Installation of the new inner double bottom hull 15 from the side of the tanker to be rebuilt was discussed in more detail above with reference to FIGS. 9–11C.

While installing the new outer side hull externally over the existing side hull provides certain advantages, it may also result in a speed loss for the rebuilt tanker due to an increase resistance of the rebuilt tanker as it passes through the water. As discussed previously, faired sections 75 (as shown in FIGS. 4 and 5) are preferably used to help smooth out the transition between the new outer side hulls 17 and the outer hull 4 of the existing single hull 2 proximate the bow section 70 and the stern section 71. The faired sections 75 act to streamline flow at the transition between the new outer side hull 17 and the existing hull 2. Also, the faired sections 75 help to minimize any speed loss for the tanker by reducing the resistance of the tanker as it passes through the water. In addition, the aft faired sections 75 are preferably also designed to help maintain and/or optimize the hull and propeller interface to help ensure a smooth fluid flow into the propeller. In designing the faired sections 75, the particular characteristics (such as, for example, size and hull form) of the tanker should be taken into account as these factors can influence the optimum design of the faired sections 75.

To this end, the present invention includes the study of the rebuilt tanker hydrodynamics, including model testing and/or computational fluid dynamics (CFD), to help determine and design the optimal characteristics of the rebuilt double hull and faired sections 75 for a particular tanker to be rebuilt.

In one embodiment, a model of the tanker hull is constructed, including the new outer side hull. The model is preferably a scaled replica of the rebuilt tanker's new exterior hull form. Various designs of the faired sections 75 are then developed and tested in the model basin to determine the optimal design of the faired sections based of a particular tanker hull form. Model testing can include one or more of the following tests and comparisons: (a) flow fields in the bow region; (b) flow fields in the stern region; (c) surface pressure contours at the bow region below the waterline; (d) surface pressure contours at the stern region below the waterline; (e) bow wave contours; and (f) bare-hull resistance.

One method of developing different designs to be tested is through the use of a molding material and can be applied to the hull of the model to simulate various embodiment of the faired sections. The molding material can include, for example, clay or putty. The molding material should include a material that can be applied in successive layers to the exterior hull form of the model and that will adhere to and not fall off the model during testing. The model can be tested in a model basin after the application of each successive layer of putty lines to the model and the results of the model basin testing can be used to help determine the optimal shape and design of the faired sections 75.

Figure 19A:
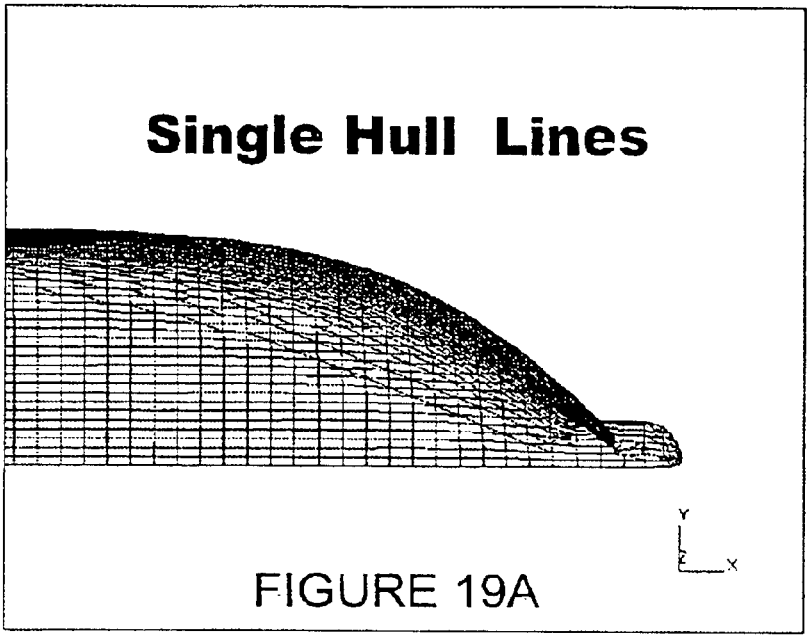
FIGS. 19A–19D show several embodiments of modeling the transition regions in the bow region.
Figure 19B:
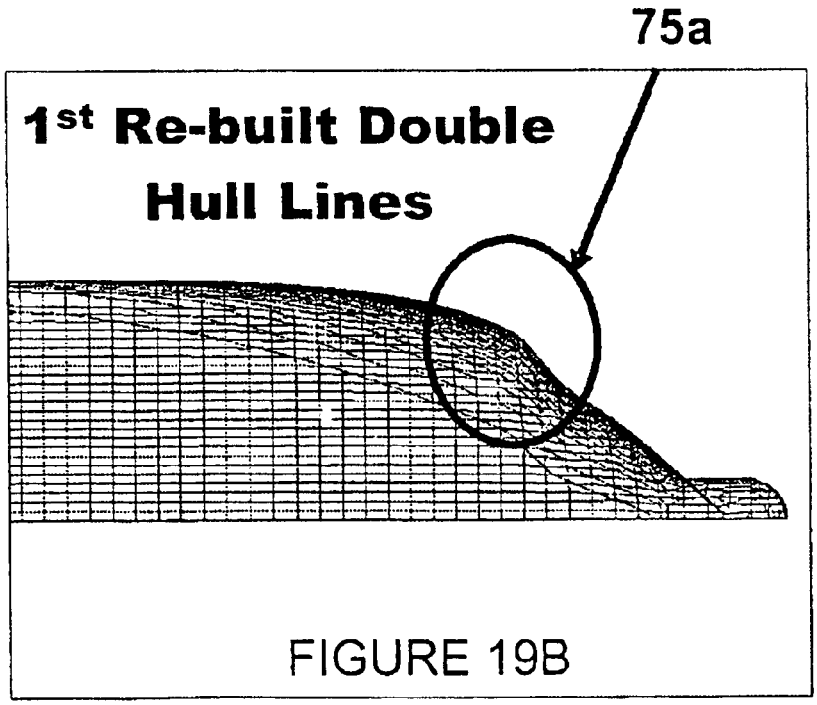
Figure 19C:
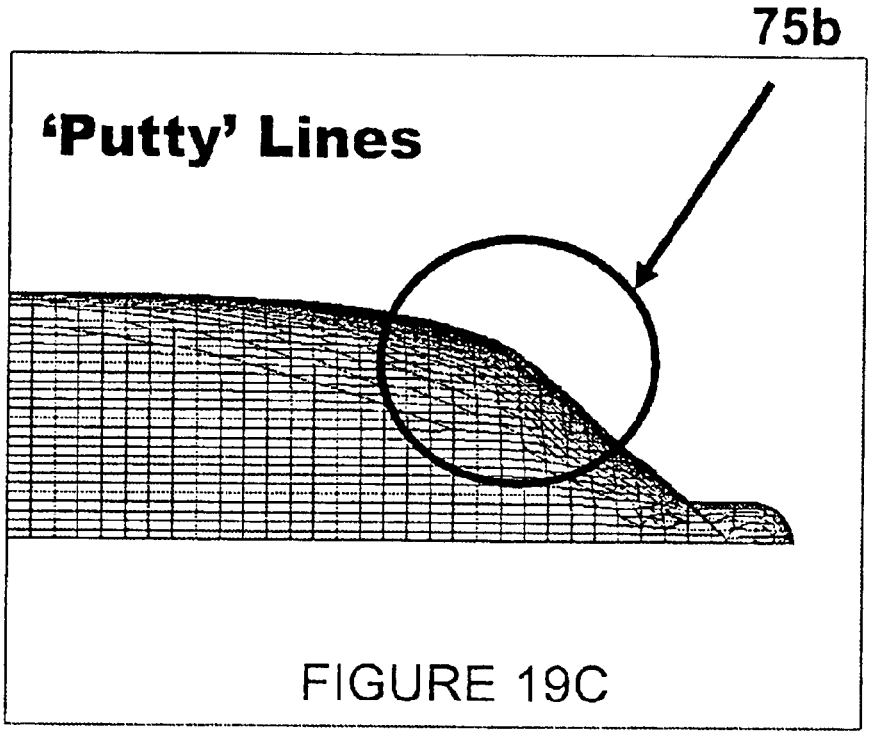
Figure 19D:
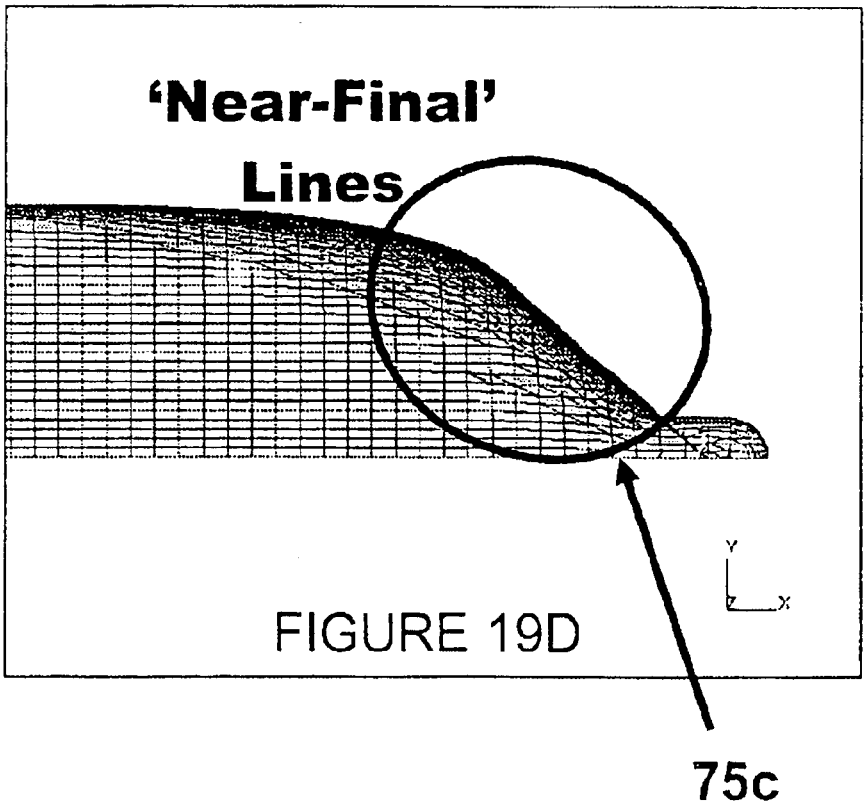
Figure 20A:
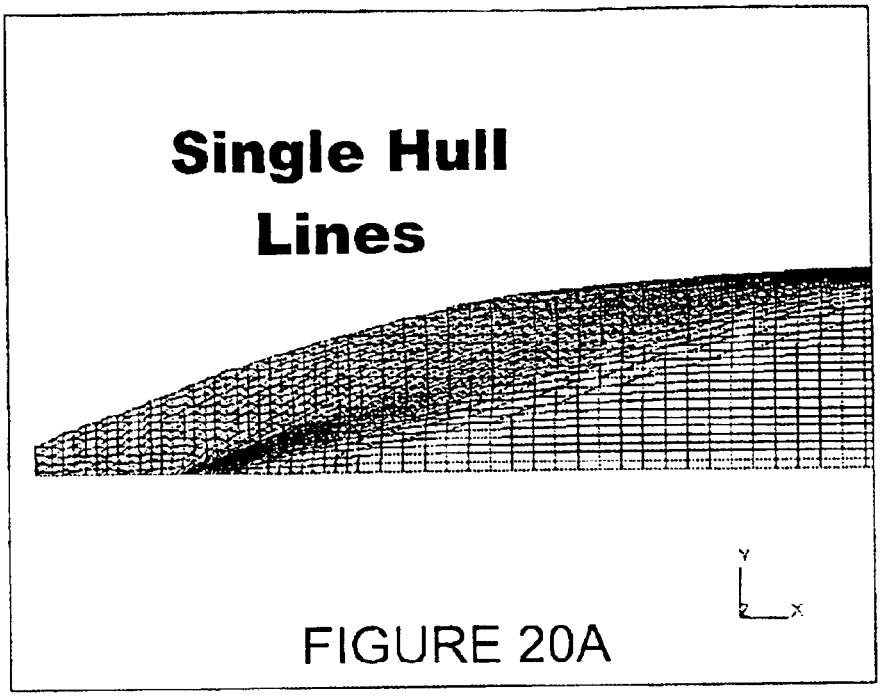
FIGS. 20A–20D show several embodiments of modeling the transition regions in the stern region.
Figure 20B:
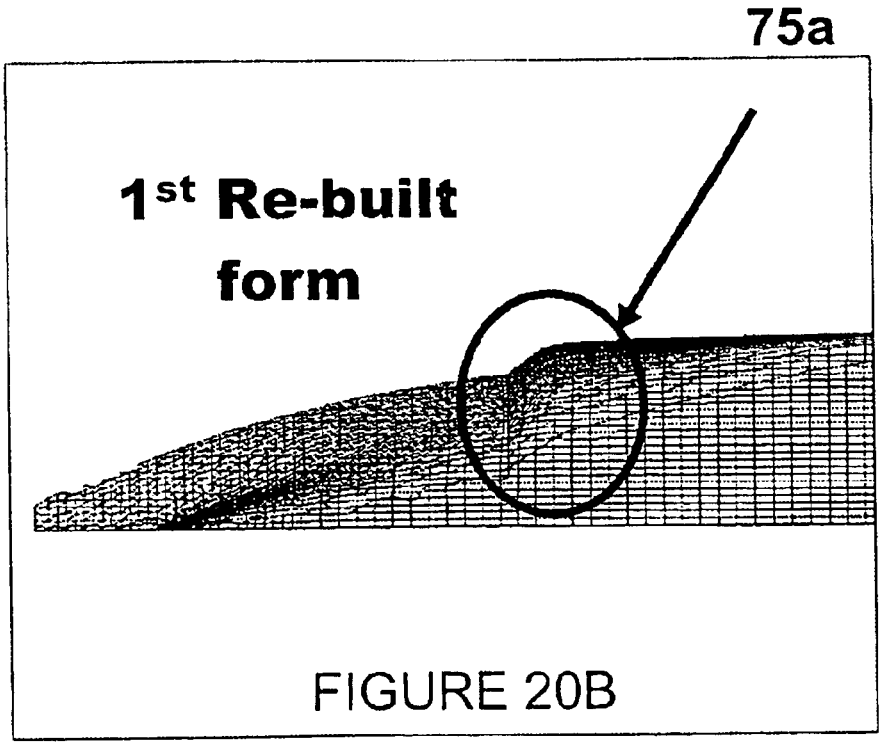
Figure 20C:
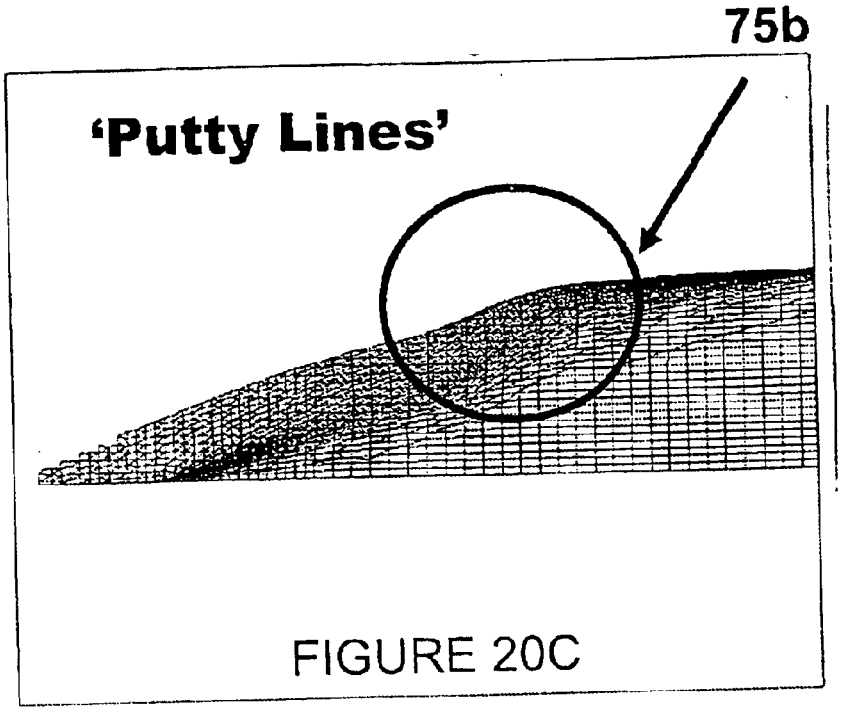
Figure 20D:
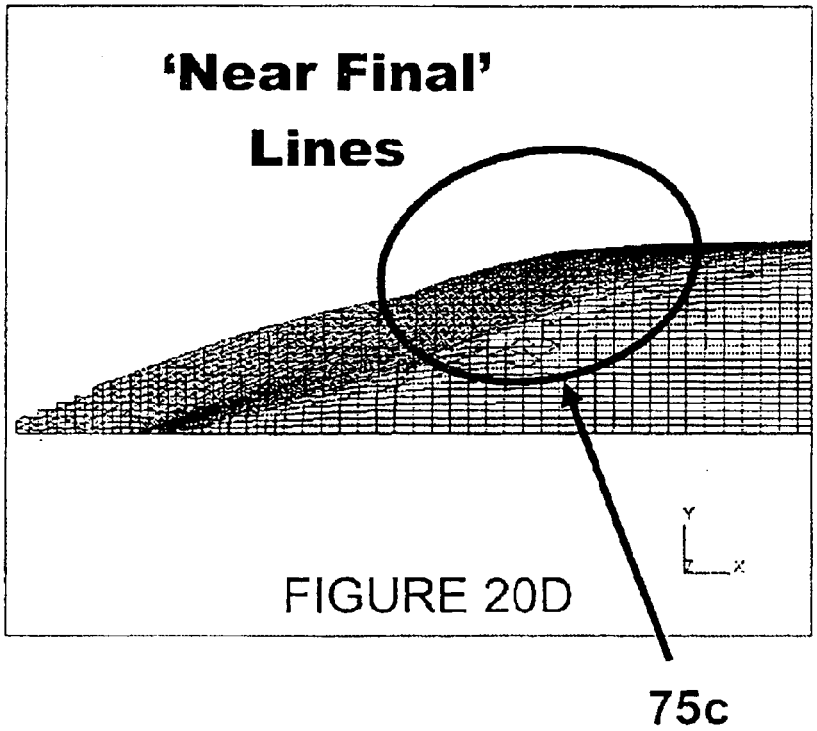

FIGS. 19A–19D and FIGS. 20A–20D illustrate exemplary modeling that uses a putty material and putty lines to simulate various hull forms in the transition regions between the new outer side hull and the existing hull in the bow and stern regions. FIGS. 19A and 20A show the hull lines for the existing single hull tanker at the bow region and stern region, respectively. FIGS. 19B–19D illustrate alternative embodiments that show additional details of the faired sections 75 between the new outer hull side hulls 17 and the existing outer hull 4 at the bow region. FIGS. 20B–20D illustrate alternative embodiments that show additional details of the faired sections 75 between the new outer hull side hulls 17 and the existing outer hull 4 at the stern region.

FIGS. 19B and 20B show a first transition, at the bow region and the stern region respectively, having a relatively abrupt faired section 75*a* in which the faired section 75*a* has a relatively short fore and aft length. FIGS. 19C and 20C show a second transition having an intermediate faired section 75*b*, which extends the fore and aft length of the faired section 75*b*. FIGS. 19D and 20D show a third transition having an extended faired sections 75*c* in which the faired section has a relatively long fore and aft length.

Figures 21A, 21B:
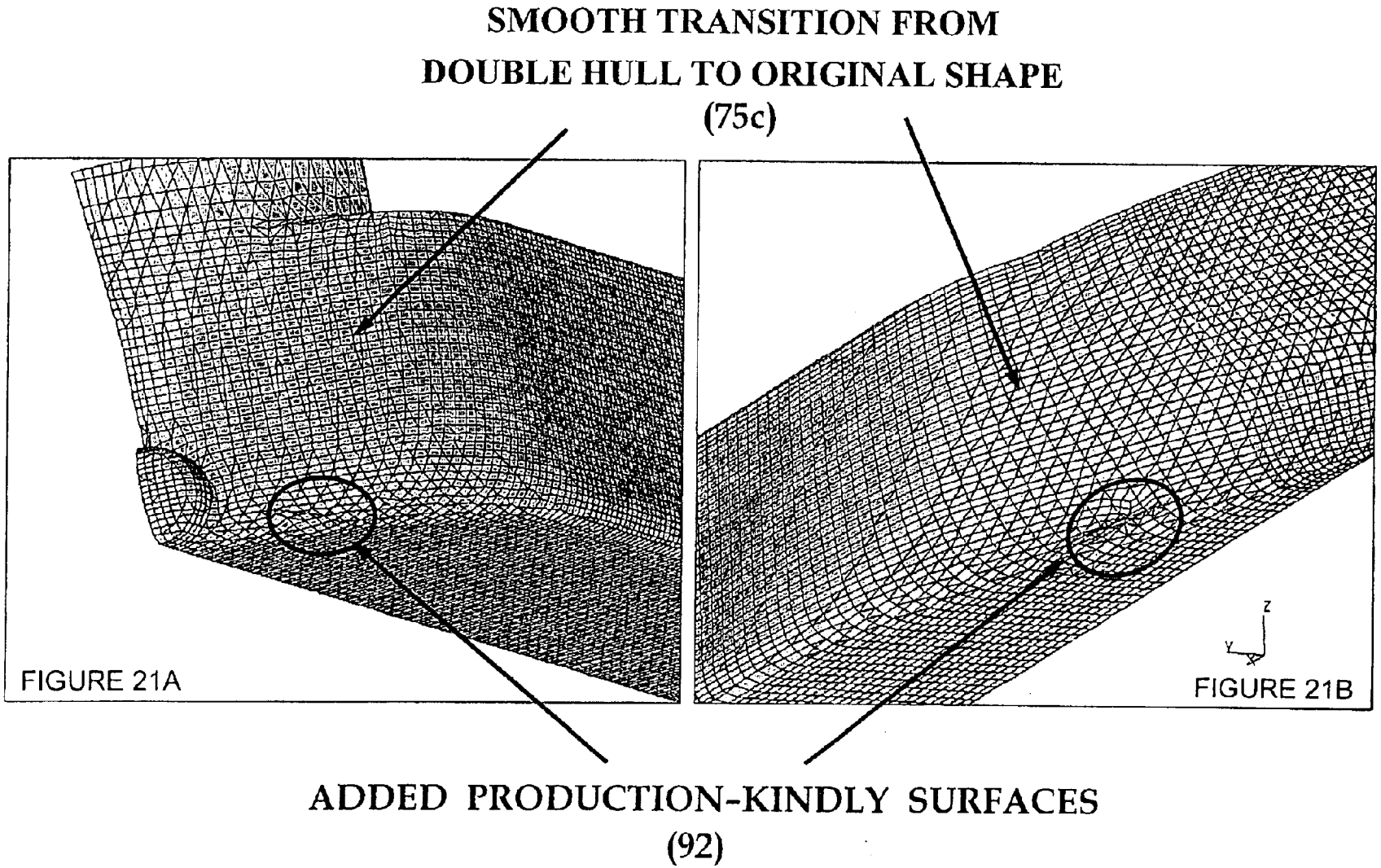
FIGS. 21A–21B show the near-final hull form resulting from the model testing in the transition regions of the bow and stern regions.

FIGS. 21A and 21B show the near-final hull form having a relatively smooth transition between the new outer side hull 17 and the existing side hull 16 at the bow region and the stern region, respectively. Also, as shown in FIGS. 21A and 21B, the transitions between the new outer side hull and the existing side hull may include production-kindly surfaces or chines 92, which basically include flat areas that make it easier to construct, in certain locations to aid in manufacture of the transition region and reduce costs.

As shown by the model basin testing, increasing the length of the faired section 75 generally improves the hydrodynamic characteristics of the faired sections 75 by reducing the drag caused by the new external side hulls 17. This results in a reduction of any speed loss for the rebuilt double hull tanker 10.

Figure 22:
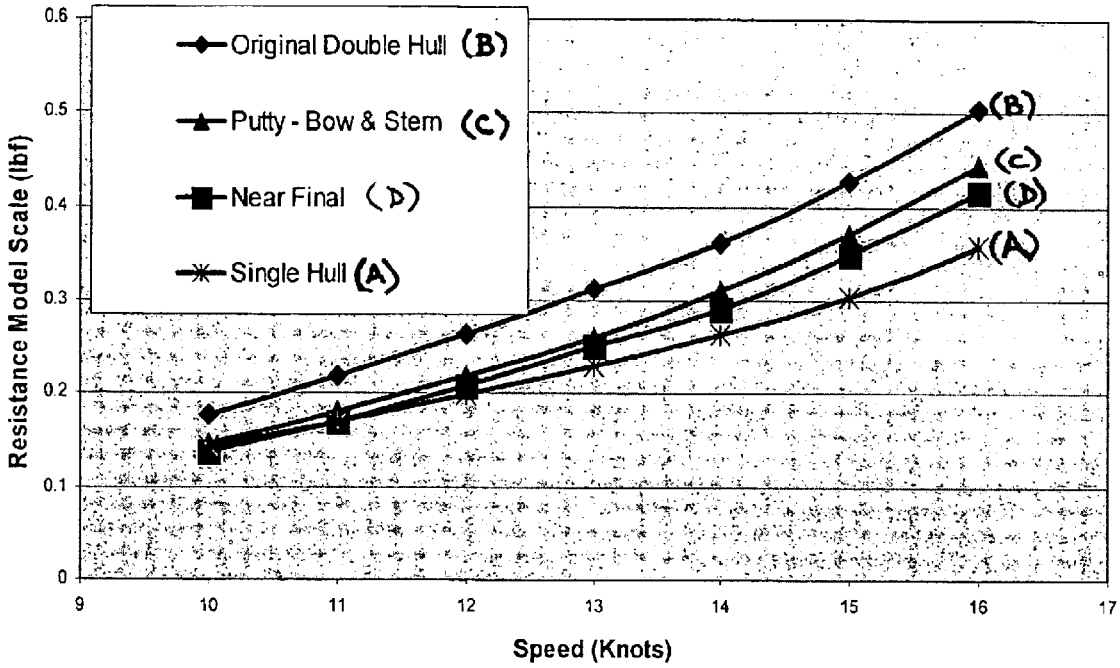
FIG. 22 shows the results of the model basin testing illustrating the relationship between resistance of the various hull forms and speed loss.

FIG. 22 is a graph of resistance versus speed and illustrates the results of the model basin testing for the different embodiments of the transition regions, as shown in FIGS. 19B–20D. FIG. 22 shows how the tanker experiences a speed loss as the resistance of the hull through the water increases. Line A shows the resistance for the existing single hull, as shown in FIGS. 19A and 20A. Line B shows the increased resistance for the original double hull having the first transition region (short fairing section 75*a*), as shown in FIGS. 19B and 20B. Line C shows a decrease in the resistance for the double hull having the second transition region (intermediate fairing section 75*b*), as shown in FIGS. 19C and 20C. Line D shows a further decrease in the resistance for the double hull having the third transition region (near-final lines of the extended fairing section 75*c*), as shown in FIGS. 19D and 20D.

In another embodiment, the study of the rebuilt tanker hydrodynamics can include computational fluid dynamics (CFD). CFD is the solution of basic equations of fluid motion by massive iterative computations. This method provides what can be termed "virtual model testing." CFD can include one or more of the following computations and comparisons: (a) flow fields in the bow region; (b) flow fields in the stern region; (c) surface pressure contours at the bow region below the waterline; (d) surface pressure contours at the stern region below the waterline; (e) bow wave contours; and (f) bare-hull resistance. A suitable software package, such as, for example, PROSTAR 3.10, can be used to perform the CFD.

CFD in the area of flow fields in the bow region and/or the stern region can be performed for the existing single hull form and each of the hull forms for the various embodiments, such as the exemplary transition regions of FIGS. 19B–19D and 20B–20D, to determine the flow field profile for each hull form. A comparison can then be made between the flow field profile of the existing single hull tanker and the flow field profiles for each of the rebuilt hull forms. Preferably, a flow field profile having a smooth flow field and that most closely matches the flow field profile of the existing single hull tanker is achieved. Preferably, the CFD provides a flow field profile at the bow region having a smooth flow field profile including reduced troughs and heights. Preferably, the CFD provides a flow wave profile at the stern region having a smooth flow field profile including no or reduced recirculation and no or reduced deceleration.

Also, CFD can be performed in the area of surface pressure contours at the bow region and/or the stern region below the waterline for the existing single hull form and each of the hull forms for the various embodiments, such as the exemplary transition regions of FIGS. 19B–19D and 20B–20D, to determine the pressure exerted on the rebuilt tanker hull for each hull form. A comparison of the surface pressure for each hull form can then be made to determine the optimal or desired hull form for the rebuilt double hull tanker. Preferably, the CFD provides a smooth pressure gradient from the forward-most portion of the bow decreasing moving aft through the bow region. The preferred surface pressure contours avoids multiple regions of increased surface pressure across the bow region (which typically signify regions of deceleration) moving from the forward-most portion of the bow and moving aft. Preferably, the CFD allows selection of the hull form of the rebuilt double hull tanker having surface pressure contours that most closely match the surface pressure contours of the existing single hull tanker.

In addition, CFD in the area of forebody wave profiles can be performed for the existing single hull form and each of the hull forms for the various embodiments, such as the exemplary transition regions of FIGS. 19B–19D and 20B–20D, to determine the forebody wave profiles for each hull form. A comparison can then be made between the forebody wave profile of the existing single hull tanker and the forebody wave profiles for each of the rebuilt hull forms. Preferably, a wave profile having a smooth forebody wave profile and that most closely matches the forebody wave profile of the existing single hull tanker is achieved. Preferably, the CFD provides a forebody wave profile at the forebody of the rebuilt tanker having a smooth wave profile including reduced wave troughs and wave heights.

Figures 23A, 23B:
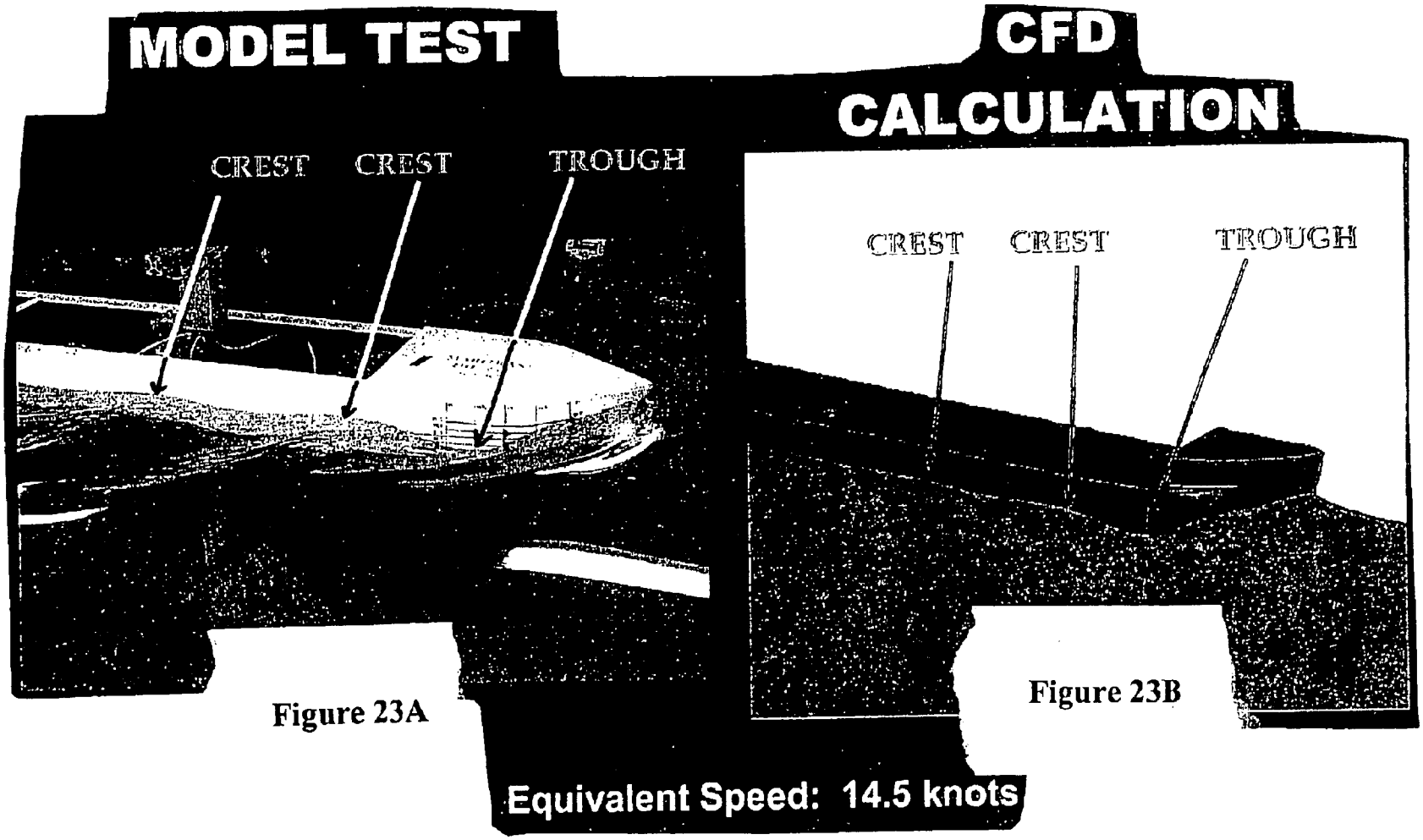
FIGS. 23A and 23B show a comparison of the results of the model basin testing and the CFD calculation illustrating the bow wave comparison of the near-final hull form.

FIGS. 23A and 23B show a comparison of the results of the model basin testing and the CFD calculation illustrating the bow wave comparison of the near-final hull form. FIG. 23A shows the model test wave profile having a trough and several wave crests and FIG. 23B shows the CFD calculation for the same hull full. As can be seen from FIGS. 23A and 23B, the results show good correlation between the model testing and the CFD calculation.

Figure 24:
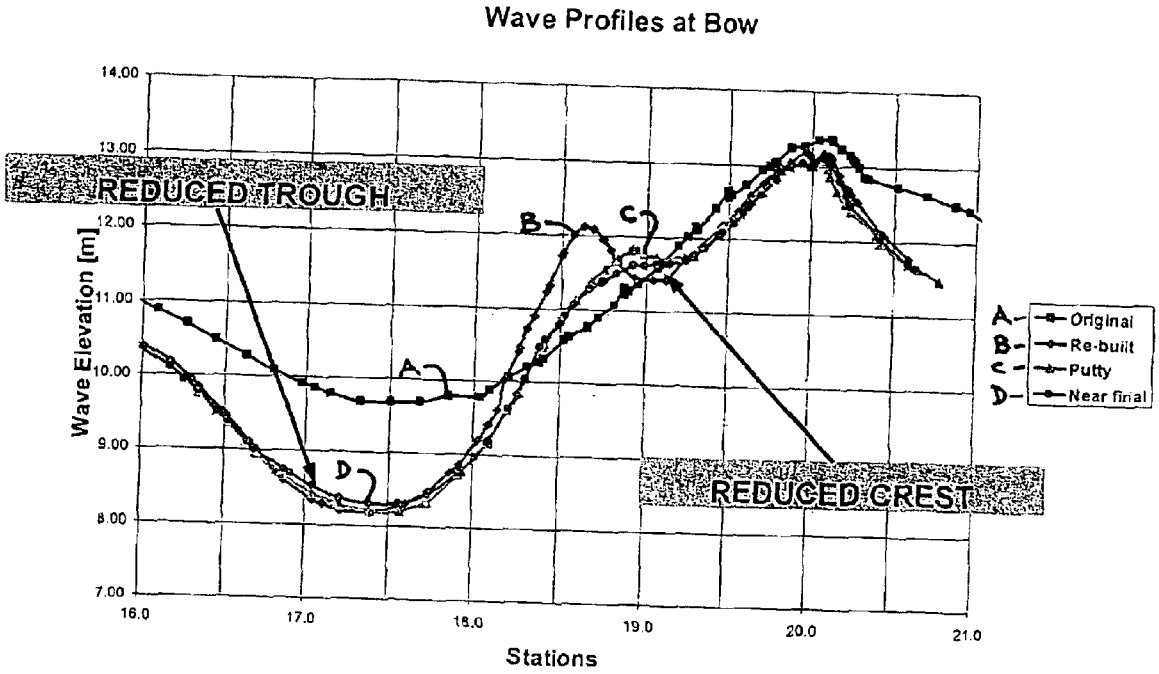
FIG. 24 shows the results of the model basin testing illustrating the bow wave comparison of the various hull forms.

FIG. 24 is a graph of wave elevation versus stations (locations) on the tanker hull and illustrates a comparison of the wave profiles at the bow for the various embodiments of the transition regions. As shown, line A shows the calculated wave profile of the existing single hull. Line B shows the calculated wave profile of the rebuilt double hull having the first transition region (short fairing section 75*a*). Line C shows the calculated wave profile of the rebuilt double hull having the second transition region (intermediate fairing section 75*b*). Line D shows the calculated wave profile of the rebuilt double hull having the third transition region (extended fairing section 75*c*). As shown, the calculated wave profile of the rebuilt double hull having the third transition region (extended fairing section 75*c*) most closely matches the calculated wave profile of the existing single hull tanker. As shown, line D for the rebuilt double hull having the third transition region (extended fairing section 75*b*) illustrates how CFD helps to determine that the extended fairing section reduces the crest of the bow wave proximate station 18.8 and also reduces the trough of the bow wave proximate station 17.5.

Furthermore, CFD can be used to calculate bare-hull resistance for the various hull forms, to help determine the potential effect on speed for each hull form. A comparison can then be made between the bare-hull resistance of the existing single hull tanker and the bare-hull resistance for each of the rebuilt hull forms. Preferably, a hull form having a low bare-hull resistance and that most closely matches that of the existing single hull tanker is achieved.

Even more preferable, the study of the rebuilt tanker hydrodynamics can include both model basin testing and CFD. The use of redundant methods of modeling and computing the optimal hull form helps to provide correlation of results between the model testing and the CFD to ensure that the hull form of the rebuilt tanker is optimized to improve performance of the rebuilt hull form (e.g., reduce the resistance of the hull as it flows through the water). This helps to minimize any speed loss for the rebuilt double hull tanker caused by the addition of the new outer side hull over the exterior of the existing hull. In addition, both the model basin testing and CFD are preferably conducted to design the hull form of the rebuilt tanker to also optimize fluid flow into the propeller.

Figure 25:
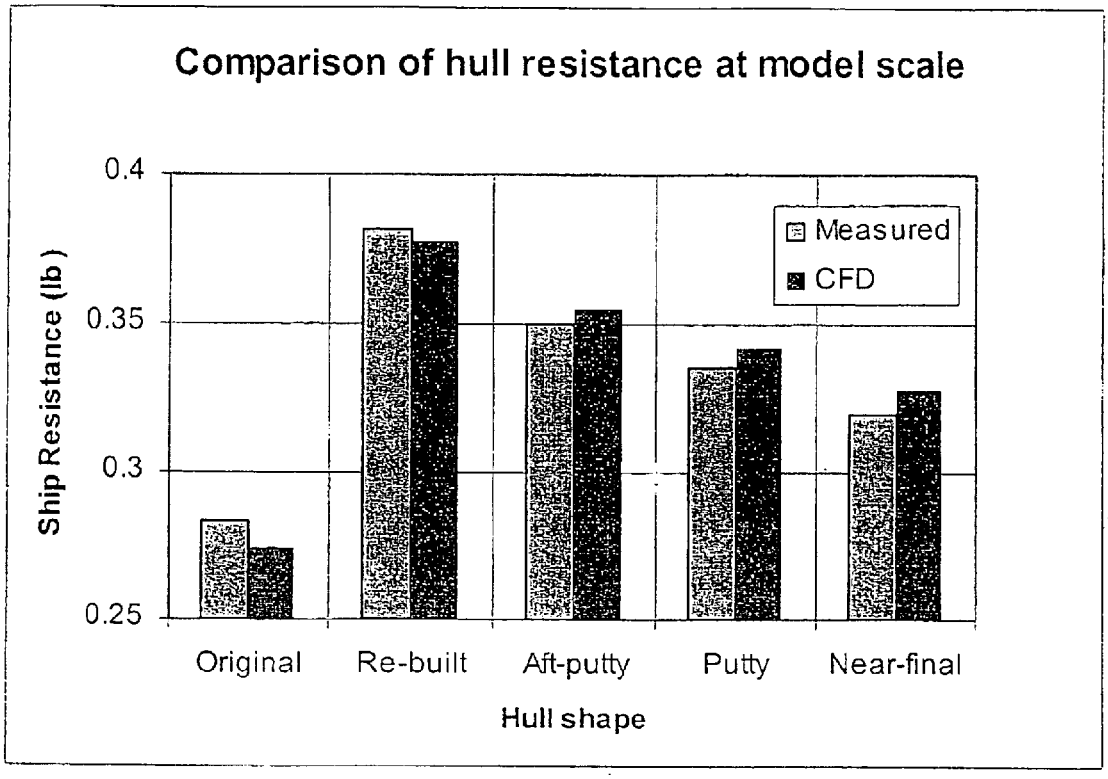
FIG. 25 shows a comparison of the results of the bare-hull resistance at model scale measured versus calculated (CFD) for the various hull forms.

FIG. 25 is a graph of ship resistance versus hull shape and compares the measured hull resistance to the calculated hull resistance for the existing single hull tanker and the various transition regions for the rebuild double hull tanker at the model scale. As illustrated in FIG. 25, the model testing and the CFD show relatively good correlation and helps to ensure an optimal hull form design for the rebuilt double hull tanker. Comparisons of the results of the model testing and the CFD can be performed for other parameters as well.

Advantages and Features of Preferred Embodiments

The process of the present invention provides several enhancements in that all the rebuild work is done from the side and therefore deck machinery and equipment is essentially undisturbed.

Also, the existing ship structure is preferably reused to the maximum extent possible. For example, the inner bottom stiffening members inside the cargo tank 22 preferably takes advantage of the existing transverse members being over two meters high, the existing support brackets are preferably cut, notched, and reused on top of new inner bottom plating, the existing turn of bilge (e.g., the curved side shell plate and bilge keel) is cut, moved outboard and reused, etc. The outer wing tank brackets can be eliminated due to the design of the new double side hulls 13. The method of attaching new outer double side hulls 13 using connecting plates 39 provides for dimensional flexibility during fit-up.

The capacity of the rebuilt tanker 10 can be substantially maintained by conversion of the existing ballast tanks to cargo tanks. The draft of the rebuilt tanker 10 can be reduced for the same cargo load through the use of external double sides 13 that result in an increase in buoyancy for the rebuilt tanker 10. The baseline BL of the rebuilt tanker 10 remains substantially the same due to the new double bottom 12 using a new inner bottom hull 15 that is installed internally from the side of the tanker over the existing outer bottom hull 14.

Smoothing hydrodynamic transition fore & aft with elastomer fairing compound.

While the invention has been particularly shown and described with reference to preferred embodiments thereof, it will be understood by those skilled in the art that various alterations in form and detail may be made therein without departing from the spirit and scope of the invention. In particular, the specific shape and size of the tanker, the shape of the transition pieces, the order of installation of the new inner hull sections, the specific number and shape of the filler pieces and plates, and the means for cutting, removing, modifying, and reinstalling the various sections can be altered depending on the specific application without departing from the scope of the invention.

What is claimed is:

1. A method of rebuilding an existing single hull tanker into a rebuilt double hull tanker comprising:

forming an outer bottom hull from existing outer bottom plating;

cutting temporary cut-outs in existing topside decking;

installing at least a portion of a new inner bottom hull through said temporary cut-outs in said existing topside decking;

forming said new inner bottom hull from new inner bottom plating installed internally over said existing outer bottom plating;

connecting said new inner bottom hull and said existing outer bottom hull in a spaced apart relationship using a plurality of connecting members to form a new double bottom hull;

forming inner side hulls from existing inner side plating;

forming new outer side hulls from new outer side plating installed externally over said existing inner side plating; and connecting said existing inner side hulls and said new outer side hulls in a spaced apart relationship using a plurality of connecting members to form new port and starboard double side hulls;

wherein said new double bottom hull and said new double side hulls form a new double hull over at least a cargo carrying portion of said rebuilt double hull tanker.

2. The method according to claim 1, wherein said existing single hull tanker further comprises at least one center cargo tank, a port wing cargo tank, and a starboard wing cargo tank, said method further comprising the steps of:

cutting at least one temporary cut-out in said existing topside decking at a location between adjacent transverse bulkheads for each of said at least one center cargo tanks; and installing at least a center portion of said new inner bottom hull through said at least one temporary cut-out internally over existing web framing of each of said at least one center cargo tanks between said adjacent transverse bulkheads.

3. The method according to claim 2, said method further comprising the steps of:

cutting at least one temporary cut-out in said existing topside decking at a location above each of said at least one center cargo tanks between adjacent longitudinal bulkheads; and installing at least a center portion of said new inner bottom hull through said at least one temporary cut-out internally over said existing web framing of each of said at least one center cargo tanks between said adjacent longitudinal bulkheads.

4. The method according to claim 2, said method further comprising the steps of:

cutting at least one temporary cut-out in said existing topside decking at a location above said port wing cargo tank between said existing side hull and an immediately inboard longitudinal bulkhead for each port wing cargo tank;

installing at least a port side portion of said new inner bottom hull through said at least one temporary cut-out and internally over existing web framing for each port cargo wing tank;

cutting at least one temporary cut-out in said existing topside decking at a location above said starboard wing cargo tank between said existing side hull and an immediately inboard longitudinal bulkhead for each starboard wing cargo tank; and installing at least a starboard side portion of said new inner bottom hull through said at least one temporary cut-out and internally over existing web framing for each starboard cargo wing tank.

5. The method according to claim 2, said method further comprising the steps of:

cutting temporary access holes into said existing port side plating at a location above a turn of the bilge and existing web framing of said existing single hull;

installing at least a port side portion of said new inner bottom hull through said temporary access holes in said existing port side plating and internally over said existing web framing for each port cargo wing tank;

cutting temporary access holes into said existing starboard side plating at a location above a turn of the bilge and existing web framing of said existing single hull; and installing at least a starboard side portion of said new inner bottom hull through said temporary access holes in said existing starboard side plating and internally over said existing web framing for each starboard cargo wing tank.

6. The method according to claim 5, said method further comprising the steps of:

renewing existing side plating that was removed to form said temporary access holes to form inserts; and closing said temporary access holes in said existing side plating using said inserts after installation of said new inner bottom hull.

7. The method according to claim 1, said method further comprising the step of locating said temporary cut-outs in said existing topside decking at a location that minimizes the disruption of existing machinery and piping.

8. The method according to claim 1, wherein said temporary cut-outs further comprise a length and a width, said method further comprising the step of orienting said length of said temporary cut-out athwartships.

9. The method according to claim 1, wherein said temporary cut-outs further comprise a length and a width, said method further comprising the step of orienting said length of said temporary cut-out fore and aft.

10. The method according to claim 1, said method further comprising the step of closing said temporary cut-outs in said existing topside decking using inserts.

11. The method according to claim 1, said method further comprising the steps of:

renewing existing topside decking that was removed to form said temporary cut-out to form inserts; and closing said temporary cut-outs in said existing topside decking using said inserts after installation of said new inner bottom hull.

12. The method according to claim 1, said method further comprising the steps of:

cutting existing port and starboard turn of the bilges and temporarily removing said port and starboard turn of the bilges;

connecting new port and starboard bottom filler pieces to each outboard end of said new double bottom hull where said existing port and starboard turn of the bilges were cut-away and scribing said new bottom filler pieces to match said new double bottom hull;

connecting said cut-away portions of said port and starboard turn of the bilges to an outboard end of each of said new port and starboard bottom filler pieces, respectively;

connecting new port and starboard outer side filler pieces over an exterior of said existing port and starboard inner side hulls and connecting said new port and starboard outer side filler pieces to said existing port and starboard turn of the bilges; and scribing new outer portions of topside deck plating of said new port and starboard outer side filler pieces to match a contour of the shear strake of existing topside deck plating.

13. The method according to claim 1, said method further comprising the steps of:

connecting said existing outer bottom hull plating and said new inner hull plating in a spaced-apart relationship using existing transverse web framing to form a central portion of said rebuilt double bottom hull;

forming new longitudinal stiffener members on a topside of said new inner hull plating;

fitting and connecting new port and starboard bottom filler pieces to port and starboard outboard ends of said central portion of said rebuilt double bottom hull, said bottom filler pieces having a width substantially equal to a width of said new double side hulls;

connecting existing port and starboard turn of the bilges to port and starboard outboard ends, respectively, of said new bottom filler pieces;

fitting and connecting new port and starboard side filler pieces to said port and starboard existing turn of the bilges, respectively, and connecting said new side filler pieces to said existing inner side hull plating using new connecting plates; and fitting and connecting new port and starboard outer portions of topside deck plating over said new port and starboard side filler pieces and connecting said new port and starboard outer portions of topside deck plating to an outer port and starboard peripheral edge of existing topside deck plating.

14. The method according to claim 1, said method further comprising the steps of:

forming one or more of slots in said new inner bottom plating at a location corresponding to a location of existing support brackets between existing longitudinal bulkheads and existing transverse framing members;

laying said new inner bottom plating on said existing transverse framing members and fitting said one or more slots in said new inner bottom plating around said existing support brackets; and filling a space between said one or more slots in said new inner bottom plating and said existing support brackets.

15. The method according to claim 1, said method further comprising the steps of:

forming faired sections in a transition region between said new outer side hulls and said existing side hulls proximate a bow region and a stern region; and designing said faired sections to provide a relatively smooth transition region between said new outer side hulls and said existing side hulls proximate a bow region and a stern region for a smoothing hydrodynamic transition fore and aft in the area where said new double side hull and said existing single side hull meet.

16. The method according to claim 15, wherein said designing step further comprises one or more of the following steps:

performing model basin testing of a model replica of said tanker to be rebuilt; and performing computational fluid dynamics of said tanker to be rebuilt.

17. The method according to claim 16, wherein said step of performing model basin testing further comprises the steps of testing and comparing one or more of:

flow fields in the bow region;

flow fields in the stern region;

surface pressure contours at the bow region below the waterline;

surface pressure contours at the stern region below the waterline;

bow wave contours; and bare-hull resistance.

18. The method according to claim 16, wherein said step of performing model basin testing further comprises the steps of:

constructing a model representative of said existing single hull tanker;

testing said model representative of said existing single hull tanker;

constructing a model representative of said rebuilt double hull tanker;

testing said model representative of said rebuilt double hull tanker;

using a molding material to simulate one or more design for said faired sections by applying successive layers of said molding material to an exterior of said model replica of said rebuilt double hull tanker to be rebuilt in a bow transition region and a stern transition region;

comparing results of said testing of said model representative of said existing single hull tanker with results of said testing of said model representative of said rebuilt double hull tanker having said successive layers of said molding material; and designing said faired sections based on said comparison of said model basin testing.

19. The method according to claim 16, wherein said step of performing computational fluid dynamics further com prises the steps of computing of and comparing one or more of:

flow fields in the bow region;

flow fields in the stern region;

surface pressure contours at the bow region below the waterline;

surface pressure contours at the stern region below the waterline;

bow wave contours; and bare-hull resistance.

20. The method according to claim 16, wherein said step of performing computational fluid dynamics further comprises the steps of:

providing a computing system having software for performing basic equations of fluid motion by massive iterative computations;

inputting data representative of said existing single hull tanker;

generating results for said existing single hull tanker;

inputting data representative of one or more designs for said faired sections of said tanker to be rebuilt;

generating results for said tanker to be rebuilt;

comparing results of said computations of said existing single hull tanker with results of said computations of said rebuilt double hull tanker having one or more designs for said faired sections; and designing said faired sections based on said comparison of said computational fluid dynamics.

21. The method according to claim 16, further comprising the steps of:

comparing results of said step of performing model basin testing with results of said step of performing computation fluid dynamics; and designing said faired sections based on said comparison of said model basin testing and said computational fluid dynamics.

22. A method of rebuilding an existing single hull tanker into a rebuilt double hull tanker comprising the steps of:

forming an outer bottom hull from existing outer bottom plating;

forming a new inner bottom hull from new inner bottom plating installed internally over said existing outer bottom plating;

connecting said new inner bottom hull and said existing outer bottom hull in a spaced apart relationship using a plurality of connecting members to form a new double bottom hull;

forming inner side hulls from existing inner side plating;

forming new outer side hulls from new outer side plating installed externally over said existing inner side plating; and connecting said existing inner side hulls and said new outer side hulls in a spaced apart relationship using a plurality of connecting members to form new port and starboard double side hulls;

wherein said new double bottom hull and said new double side hulls form a new double hull over at least a cargo carrying portion of said rebuilt double hull tanker;

forming faired sections in a transition region between said new outer side hulls and said existing side hulls; and designing said faired sections to provide a relatively smooth transition region between said new outer side hulls and said existing side hulls proximate a bow region and a stern region for a smoothing hydrodynamic transition fore and aft in the area where said new double side hull and said existing single side hull meet.

23. The method according to claim 22, wherein said designing step further comprises one or more of the following steps:

performing model basin testing of a model replica of said tanker to be rebuilt; and performing computational fluid dynamics of said tanker to be rebuilt.

24. The method according to claim 23, wherein said step of performing model basin testing further comprises the steps of testing and comparing one or more of:

flow fields in the bow region;

flow fields in the stern region;

surface pressure contours at the bow region below the waterline;

surface pressure contours at the stern region below the waterline;

bow wave contours; and bare-hull resistance.

25. The method according to claim 23, wherein said step of performing model basin testing further comprises the steps of:

constructing a model representative of said existing single hull tanker;

testing said model representative of said existing single hull tanker;

constructing a model representative of said rebuilt double hull tanker;

testing said model representative of said rebuilt double hull tanker;

using a molding material to simulate one or more design for said faired sections by applying successive layers of said molding material to an exterior of said model replica of said rebuilt double hull tanker to be rebuilt in a bow transition region and a stern transition region;

comparing results of said testing of said model representative of said existing single hull tanker with results of said testing of said model representative of said rebuilt double hull tanker having said successive layers of said molding material; and designing said faired sections based on said comparison of said model basin testing.

26. The method according to claim 23, wherein said step of performing computational fluid dynamics further comprises the steps of computing of and comparing one or more of:

flow fields in the bow region;

flow fields in the stern region;

surface pressure contours at the bow region below the waterline;

surface pressure contours at the stern region below the waterline;

bow wave contours; and bare-hull resistance.

27. The method according to claim 23, wherein said step of performing computational fluid dynamics further comprises the steps of:

providing a computing system having software for performing basic equations of fluid motion by massive iterative computations;

inputting data representative of said existing single hull tanker;

generating results for said existing single hull tanker;

inputting data representative of one or more designs for said faired sections of said tanker to be rebuilt;

generating results for said tanker to be rebuilt;

comparing results of said computations of said existing single hull tanker with results of said computations of said rebuilt double hull tanker having one or more designs for said faired sections; and designing said faired sections based on said comparison of said computational fluid dynamics.

28. The method according to claim 23, further comprising the steps of:

comparing results of said step of performing model basin testing with results of said step of performing computation fluid dynamics; and designing said faired sections based on said comparison of said model basin testing and said computational fluid dynamics.

* * * * *